US009244380B2

(12) United States Patent
Tsukada et al.

(10) Patent No.: US 9,244,380 B2
(45) Date of Patent: Jan. 26, 2016

(54) IMAGE FORMING APPARATUS

(71) Applicant: CANON KABUSHIKI KAISHA, Tokyo (JP)

(72) Inventors: Yoshiro Tsukada, Matsudo (JP); Kengo Sato, Kashiwa (JP); Tadashi Iwakawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/960,060

(22) Filed: Aug. 6, 2013

(65) Prior Publication Data

US 2014/0044446 A1 Feb. 13, 2014

(30) Foreign Application Priority Data

Aug. 8, 2012 (JP) ..... 2012-175890
Sep. 6, 2012 (JP) ..... 2012-196676

(51) Int. Cl.
*G03G 15/08* (2006.01)
*G03G 15/16* (2006.01)
*G03G 15/01* (2006.01)

(52) U.S. Cl.
CPC ..... *G03G 15/0848* (2013.01); *G03G 15/1675* (2013.01); *G03G 15/0189* (2013.01); *G03G 2215/0129* (2013.01)

(58) Field of Classification Search
CPC ..... G03G 15/0848; G03G 15/0189; G03G 15/1675; G03G 2215/0129
USPC ..... 399/50, 53, 55, 66, 302
See application file for complete search history.

(56) References Cited

U.S. PATENT DOCUMENTS

| | | | | |
|---|---|---|---|---|
| 5,692,232 | A * | 11/1997 | Okano et al. | 399/53 |
| 2005/0249526 | A1* | 11/2005 | Funamizu et al. | 399/301 |
| 2011/0026958 | A1* | 2/2011 | Shiori | 399/53 |
| 2012/0070165 | A1* | 3/2012 | Suzuki | 399/53 |
| 2012/0114350 | A1* | 5/2012 | Sakoda et al. | 399/55 |
| 2012/0155904 | A1* | 6/2012 | Kawaguchi et al. | 399/66 |

FOREIGN PATENT DOCUMENTS

JP 2012-68390 A 4/2012

* cited by examiner

*Primary Examiner* — Ryan Walsh
(74) *Attorney, Agent, or Firm* — Canon USA Inc. IP Division

(57) ABSTRACT

An image forming apparatus is capable of executing, in non-image formation, for example, in a sheet-to-sheet interval, a developer bearing member stop mode in which the developer conveyance by a development sleeve is stopped. For example, the apparatus turns off primary transfer bias in the sheet-to-sheet interval. Even if fogging toner is no longer supplied after the development sleeve drive is stopped, the apparatus can reduce frictional force variation between the photosensitive drum and the intermediate transfer belt to prevent speed variation of the photosensitive drum or the intermediate transfer belt, thus reducing the possibility of image unevenness and out of color registration.

13 Claims, 21 Drawing Sheets

IMAGE FORMING APPARATUS

BACKGROUND OF THE INVENTION

1. Field of the Invention

The present invention relates to an image forming apparatus, such as a copying machine, a printer, a facsimile, and a multifunction peripheral having these functions. More particularly, the present invention relates to a configuration capable of executing a mode in which the developer conveyance by a developer bearing member is stopped while continuing the developer conveyance within a developing device.

2. Description of the Related Art

Conventionally, in electrophotographic type image forming apparatuses, a structure of the two-component development system using toner and carrier (two-component developer) is known. With the configuration of the two-component development system, a development screw as a conveyance member stirs and conveys toner and carrier, and charges toner within a development container of the developing device. Then, a developing sleeve as a developer bearing member carries and conveys toner and carrier, and, by using charged toner, develops an electrostatic latent image formed on a photosensitive drum to form a toner image thereon. With this configuration, for example, performing continuous printing of images having a low image ratio for a prolonged time period degrades the flowability of the developer. Accordingly, an immobile layer in which the developer is present being hard to move in the development container will be easily formed.

Accordingly, a structure has been discussed in which the height of the developer surface is temporarily changed by stopping the developer conveyance by a development sleeve while continuing the developer conveyance by conveying screws in the sheet-to-sheet interval, thus breaking down a developer's immobile layer (refer to Japanese Patent Application Laid-Open No. 2012-68390).

However, as with the above-described structure discussed in Japanese Patent Application Laid-Open No. 2012 -68390, when control is performed to stop the development sleeve in the sheet-to-sheet interval, the frictional force between the photosensitive drum and the intermediate transfer member changes. Normally, a small amount of fogging toner is constantly supplied onto the photosensitive drum with the rotation of the development sleeve . Fogging toner serves as a lubricant between the photosensitive drum and the intermediate transfer member, reducing the frictional force between the photosensitive drum and the intermediate transfer member.

On the other hand, when control is performed to stop the development sleeve, fogging toner is not supplied onto the photosensitive drum and therefore does not serve as a lubricant. As a result, the mechanical adhesion force between the photosensitive drum and the intermediate transfer member increases. If a transfer bias is applied between the photosensitive drum and the intermediate transfer member, the frictional force between the photosensitive drum and the intermediate transfer member increases because of an additional effect of the electrostatic force.

On the other hand, there is a transfer method called the slip transfer method in which image transfer is performed while generating a circumferential speed difference between the photosensitive drum and the intermediate transfer member. The slip transfer method is characterized in the effect of canceling error factors, such as a geometrical error, an outside diameter error, and an average angular velocity error of the photosensitive drum, appearing as out of color registration on the intermediate transfer member.

However, in a case where fogging toner disappears and the frictional force between the photosensitive drum and the intermediate transfer member increases as described above, the photosensitive drum or the intermediate transfer member, whichever is rotating at lower speed, tends to be taken around by the member rotating at higher speed. As a result, when the load on the member rotating at lower speed rapidly decreases to a fixed low level (nearly zero), the member may become out of speed control.

When a member becomes out of speed control in this way, rotating the development sleeve again to form an image may cause speed variation in the member rotating at lower speed, possibly causing image unevenness or out of color registration. Specifically, when fogging toner is supplied between the photosensitive drum and the intermediate transfer member by the rotation of the development sleeve, the frictional force between the photosensitive drum and the intermediate transfer member decreases, causing load variation in the member rotating at lower speed. At this timing, since the member rotating at lower speed is out of speed control, load variation causes speed variation. Then, the speed variation causes phenomena, such as a degraded latent image on the photosensitive drum and transfer unevenness, resulting in image unevenness and out of color registration.

When performing high-voltage control or sheet cassette changeover at the time of non-image formation, for example, in the sheet-to-sheet interval, the drive of the developing device may be stopped to prevent developer deterioration. Also in this case, the rotation of the development sleeve is stopped, and fogging toner is no longer supplied between the photosensitive drum and the intermediate transfer member, causing the same problem as that in the above-described case.

SUMMARY OF THE INVENTION

The present invention is directed to providing a structure which enables reducing the possibility of image unevenness or out of color registration even when the once stopped developer conveyance by the developer bearing member is resumed.

According to an aspect of the present invention, an image forming apparatus includes an image bearing member configured to bear and convey an image, a developing device including a developer bearing member configured to bear a developer and convey the developer to a developing position facing the image bearing member, and a developing bias application unit configured to apply a developing bias between the developer bearing member and the image bearing member to transfer the developer conveyed to the development position onto the image bearing member based on a potential difference from the image bearing member, an image conveyance member configured to abut on the image bearing member and convey an image transferred thereon from the image bearing member or a recording material with an image transferred thereon at a speed different from the speed of the image bearing member, a transfer portion configured to apply a transfer bias to transfer an image from the image bearing member onto the image conveyance member or a recording material, and a control unit configured to be capable of executing, between images in continuous image formation, a developer bearing member stop mode in which the developer conveyance by the developer bearing member is stopped, and configured to, change an abutting state or a state of relative speed between the image bearing member and the image conveyance member in the developer bearing member stop mode from that state at the normal image transfer time in which an image formed on the image bearing member is transferred onto the image conveyance member or a recording material so as to reduce variation in relative speed between the image bearing member and the image conveyance member if the developer conveyance by the developer bearing member is resumed from the developer bearing member stop mode.

Further features and aspects of the present invention will become apparent from the following description of exemplary embodiments with reference to the attached drawings.

DESCRIPTION OF THE EMBODIMENTS

Figure 1:
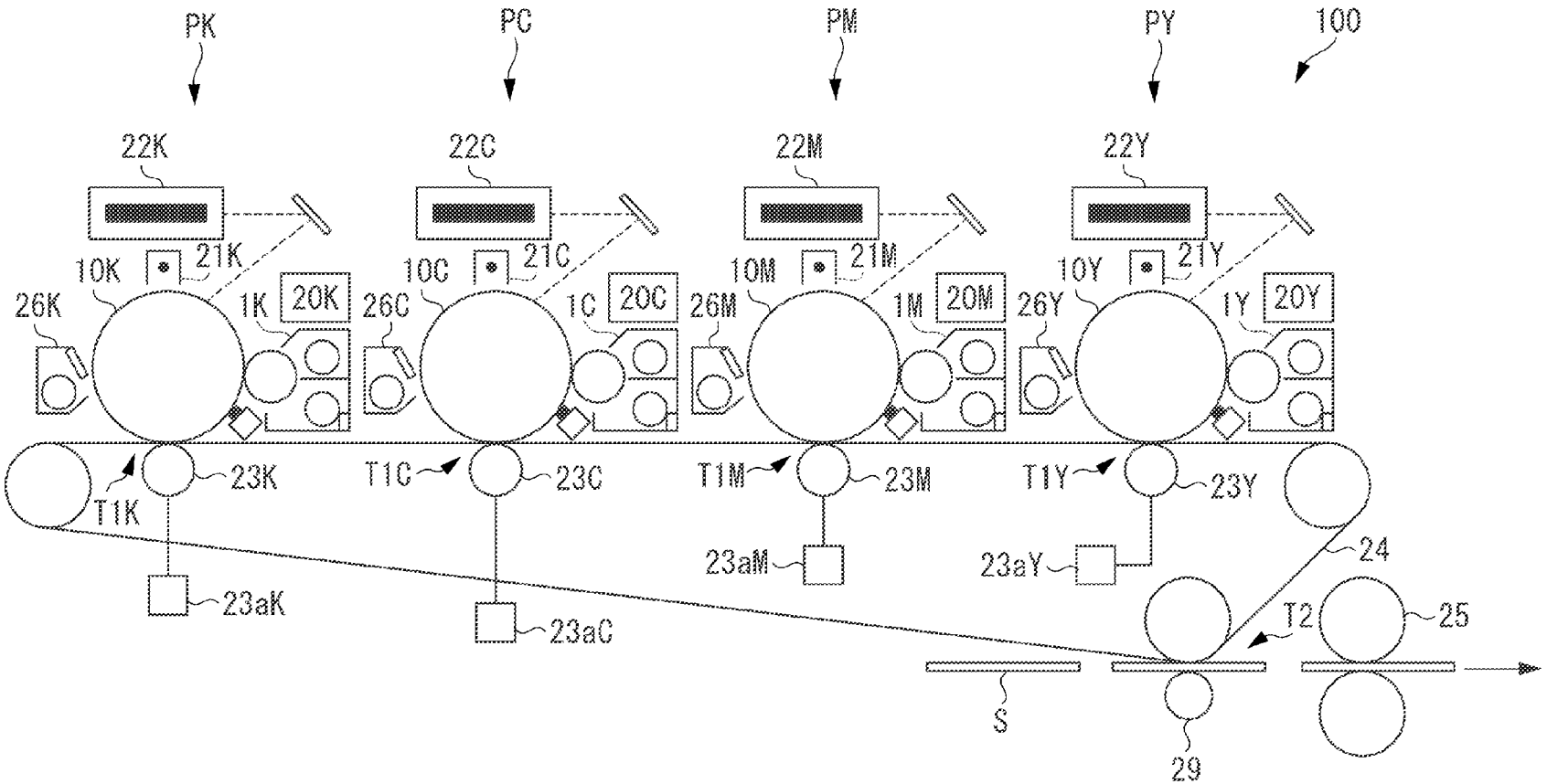
FIG. 1 is a schematic view illustrating an image forming apparatus according to a first exemplary embodiment of the present invention.

A first exemplary embodiment of the present invention will be described below with reference to Figs. 1 to 13. Although, in the present exemplary embodiment, a developing device is used, for example, in an image forming apparatus described below, the configuration is not limited thereto. The developing device is also applicable to an image forming apparatus based on the electrostatic recording process. Although, in the present exemplary embodiment, an image forming apparatus employing the full color intermediate transfer method is illustrated, the image forming apparatus according to the present invention is not limited thereto. An overall configuration of the image forming apparatus, and a configuration of each image forming unit will be described below with reference to Figs. 1 and 2, respectively.

Image Forming Apparatus

An image forming apparatus 100 employs the tandem method using image forming units PY, PM, PC, and PK for forming respective toner images of four colors (for example, Y (yellow), M (magenta), C (cyan), and K (black)). The plurality of image forming units PY, PM, PC, and PK is arranged along with the rotational direction of an intermediate transfer belt (intermediate transfer member) 24 as an image conveyance member, and performs processing in parallel for forming toner images of respective colors. Specifically, each of the plurality of image forming units PY, PM, PC, and PK includes a photosensitive drum (image bearing member), a developing device, and a primary transfer portion.

Since each image forming unit basically has an identical configuration, subscripts Y, M, C, and K indicating respective image forming units'configurations (colors) will be omitted in the following descriptions. These subscripts will be supplied only in the drawings and in descriptions when necessary.

An image forming unit P includes a photosensitive drum 10 serving as an image bearing member for forming and bearing a toner image of each color. A charging device 21, an exposure device 22, a developing device 1, a primary transfer roller 23 (transfer member), and a cleaning device 26 are arranged around the photosensitive drum 10. The intermediate transfer belt 24 for conveying a toner image transferred from the photosensitive drum 10, as described below, is arranged at a position adjacent to the photosensitive drum 10 so that the intermediate transfer belt 24 abuts on the photosensitive drum 10.

Figure 2:
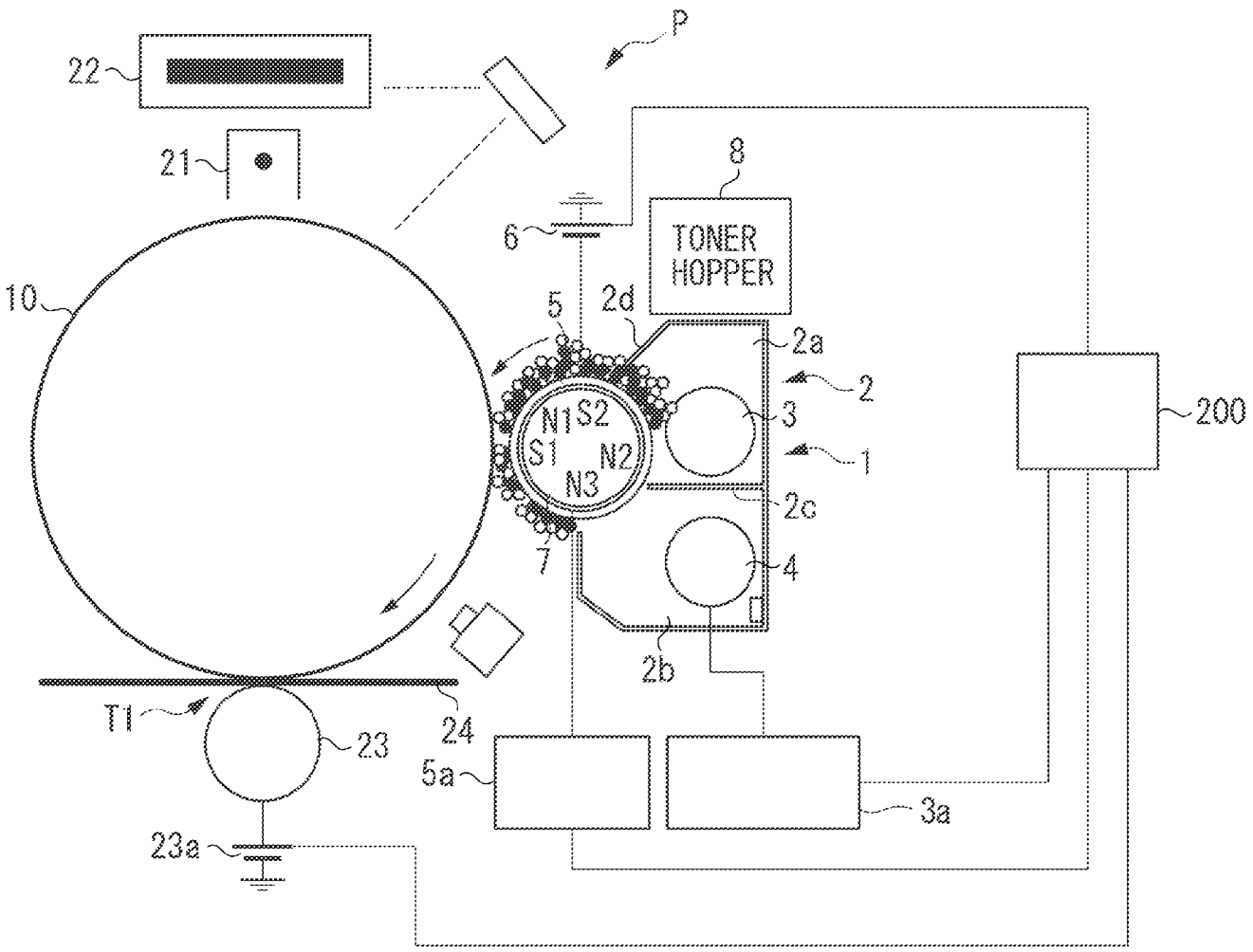
FIG. 2 is a schematic view illustrating an image forming unit according to the first exemplary embodiment.
Figure 3:
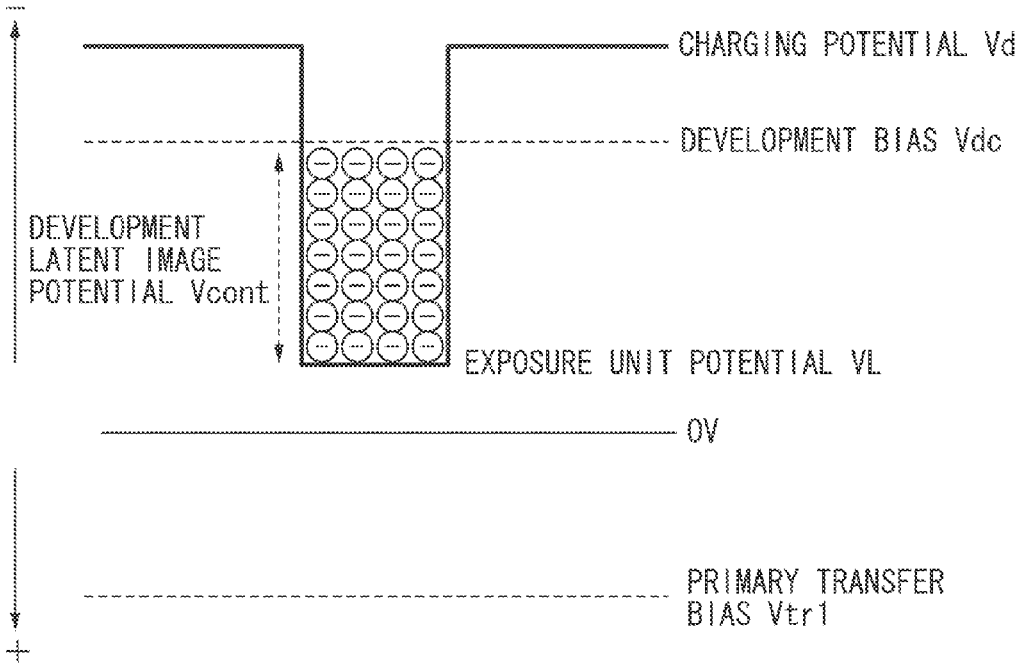
FIG. 3 schematically illustrates potential relations in the image forming unit.

Referring to FIG. 2, the photosensitive drum 10 is rotatably driven in the direction indicated by the arrow. The charging device 21 uniformly charges the surface to a predetermined potential. Then, the exposure device 22 exposes to light the surface of the photosensitive drum 10 charged to the predetermined potential, to form an electrostatic latent image on the photosensitive drum 10. For example, the exposure device 22 exposes the surface of the photosensitive drum 10 to a laser beam modulated with an image information signal, to form an electrostatic latent image (latent image). The developing device 1 develops the electrostatic latent image on the photosensitive drum 10 by using a developer to form a visible toner image.

When a primary transfer bias is applied to the primary transfer roller 23 at a primary transfer portion T1 , the toner image on the photosensitive drum 10 developed by the developing device 1 is primarily transferred onto the endless intermediate transfer belt 24. Thus, toner images of respective colors are sequentially transferred on top of each other. The primary transfer roller 23 is arranged to abut on the photosensitive drum 10 via the intermediate transfer belt 24, and connected with a power source 23*a* as a transfer bias application unit 200. The power source 23*a* applies the primary transfer bias to the primary transfer portion T1.

In the present exemplary embodiment, the power sources 23*a*Y, 23*a*M, 23*a*C, and 23*a*K are connected to the primary transfer rollers 23 Y, M, C, and K of respective image forming units, respectively, to independently apply the primary transfer bias thereto.

When a secondary transfer bias is applied to a secondary transfer roller 29, a toner image formed with full color being primary transferred on the intermediate transfer belt 24 is secondarily transferred in a lump onto a recording material S. The secondary transfer roller 29 abuts on the intermediate transfer belt 24 to be rotatably driven. After primary transfer, the cleaning device 26 removes transfer residual toner from the surface of the photosensitive drum 10 which then used for the following image formation. Further, after secondary transfer, a cleaner (not illustrated) removes transfer residual toner from the surface of the intermediate transfer belt 24 which then used for the following image formation.

A feeding unit, such as a sheet cassette and a feeding roller, conveys the recording material S up to a secondary transfer portion T2 formed of the secondary transfer roller 29 and the intermediate transfer belt 24.

After secondary transfer, the feeding unit conveys to a fixing unit 25 the recording material S with an unfixed toner image born thereon. When the fixing unit 25 heats and pressurizes the recording material S, the unfixed toner image melts and softens, and is fixed onto the recording material S. The recording material S with the toner image fixed thereon is discharged to the outside of the image forming apparatus 100.

As described above, a series of image forming processes including charging, exposure, development, transfer, and fixing is performed to form an image on the recording material S. A monochrome image forming apparatus includes only the black image forming unit. The arrangement order and configuration of the image forming units 200 Y, M, C, and K are not limited thereto.

Developing Device

The developing device 1 according to the present exemplary embodiment will be described in detail below with reference to FIG. 2. The developing device includes a development container 2 as a storage unit, conveying screws 3 and 4 as conveyance members, a development sleeve 5 as a developer bearing member, and a power source 6 as a developing bias application unit. Since the developing device 1 according to the present exemplary embodiment is of the vertical stirring type, the inside of the development container 2 is vertically partitioned at the abbreviated center section into a development chamber 2*a* and a stirring chamber 2*b* by a partition wall 2*c* extending in the direction orthogonal to the page. The developer is stored in the development chamber 2*a* and the stirring chamber 2*b*.

In the present exemplary embodiment, a two-component developer containing non-magnetic toner and carrier having low magnetization and high resistance is used as a developer. Non-magnetic toner is composed of an adequate amount of binding resins, such as styrene resin and polyester resin, an adequate amount of coloring agents, such as carbon black, dye, and pigment, an adequate amount of releasing agent, such as wax, and an adequate amount of charge control agents. Such non-magnetic toner can be manufactured through conventional methods, such as the grinding method and the polymerization method.

The development chamber 2*a* and the stirring chamber 2*b* include the conveying screws 3 and 4, respectively. The conveying screw 3 is arranged at the bottom of the development chamber 2*a* (upper chamber), almost in parallel with the axial direction of the development sleeve 5. The conveying screw 3 rotates to convey the developer in the development chamber 2*a* in one direction along the axial line while stirring the developer. The conveying screw 4 is arranged at the bottom of the stirring chamber 2*b* (lower chamber), almost in parallel with the conveying screw 3. The conveying screw 4 rotates to convey the developer in the stirring chamber 2*b* in the direction opposite to the direction of the conveying screw 3 while stirring the developer. The conveying screws 3 and 4 are rotatably driven by a motor 3*a* as a driving unit.

Thus, the rotations of the conveying screws 3 and 4 convey the developer and the developer is circulated between the development chamber 2*a* and the stirring chamber 2*b* through openings (communicating portions) at both ends of the partition wall 2*c*. As a result, the conveying screws 3 and 4 convey the developer within the storage unit (inside of the development container 2). In this case, toner is charged when carrier and toner are frictionally charged within the development container 2. The present exemplary embodiment uses negatively charged toner.

The development container 2 is provided with an opening at a position (development position) equivalent to the development region facing the photosensitive drum 10. The development sleeve 5 is rotatably arranged at the opening so that the development sleeve 5 may be partly exposed toward the photosensitive drum 10. The development sleeve 5 bears the developer conveyed by the conveying screws 3 and 4 within the development container 2, conveys the developer to the development position, and supplies the developer to the development region of the photosensitive drum 10. A regulating blade 2*d* regulates the length of a magnetic brush of the developer carried by the development sleeve 5. When the magnetic brush of the developer born by the development sleeve 5 and conveyed to the developing area with the length regulated by the regulation blade 2*d*, the magnetic brush of the developer is brought into contact with the photosensitive drum 10. Then, the electrostatic latent image on the photosensitive drum 10 is developed. A motor 5*a* (driving unit) rotatably drives the development sleeve 5. In the present exemplary embodiment, the development sleeve 5 and the conveying screws 3 and 4 are driven by respectively different driving sources, and therefore can be independently driven and stopped.

The development sleeve 5 made of a non-magnetic material, such as aluminum and stainless steel, includes a magnet roller 7 (magnetic field unit) arranged in a non-rotating state. The magnet roller 7 is provided with a developing pole S1 arranged facing the photosensitive drum 10 in the developing area. The magnet roller 7 is also provided with a magnetic pole S2 arranged facing the restriction blade 2*d*, a magnetic pole N1 arranged between the magnetic poles S1 and S2, and magnetic poles N2 and N3 arranged facing the development chamber 2*a* and the stirring chamber 2*b*, respectively.

During development, the development sleeve 5 including the magnet roller 7 rotates in the direction (counterclockwise direction) indicated by the arrow in this way to convey the developer while bearing the developer. The development sleeve 5 conveys the developer, with the layer thickness regulated through magnetic brush cutting by the regulation blade 2*d*, to the developing area facing the photosensitive drum 10, and supplies the developer to the electrostatic latent image formed on the photosensitive drum 10 to develop the latent image.

A toner hopper 8 for storing replenishment two-component developer, composed of mixture of toner and carrier, is arranged at the top of the developing device 1. A screw-shaped conveyance member disposed at the bottom of the toner hopper 8 constituting a toner replenishing unit replenishes developer (toner) into the development container 2 for developer consumed in image formation.

During development, the power source 6 applies the developing bias between the development sleeve 5 and the photosensitive drum 10 to transfer the developer (conveyed by the development sleeve 5 to the development position) onto the photosensitive drum 10 based on the potential difference between the charging potential of the photosensitive drum 10 and the development sleeve 5. The primary transfer bias is applied at the primary transfer portion T1 to transfer onto the intermediate transfer belt 24 the toner transferred on the photosensitive drum 10. This process will be described below with reference to FIG. 3.

Potential Relationships between Portions

The charging device 21 charges the surface of the photosensitive drum 10 to a negative potential (charging potential) Vd, and an exposure portion potential VL at the portion exposed by the exposure device 22 is discharged to the 0V side. For example, the charging potential Vd is set to −700V and the exposure portion potential VL is set to −200V. The development sleeve 5 conveys to the development position of the photosensitive drum 10 the developer containing toner negatively frictionally charged within the developing device 1. At this timing, the developing bias Vdc applied to the development sleeve 5 is a potential between the charging potential Vd and the exposure portion potential VL. For example, the developing bias Vdc is set to −550V.

Thus, the toner on the development sleeve 5 is developed until a sum of the exposure portion potential VL and a potential of the developed toner layer becomes the same potential as the developing bias Vdc. Specifically, an amount of toner equivalent to the development latent image potential Vcont (the difference between the developing bias Vdc and the exposure portion potential VL) is placed on the photosensitive drum 10. Thus, adjusting the development latent image potential Vcont enable adjusting the image density.

Subsequently, at the primary transfer portion T1, the negatively charged toner which flew to the photosensitive drum 10 is transferred onto the intermediate transfer belt 24 by the pressure and the electric field force between the primary transfer roller 23 and the intermediate transfer belt 24. At this timing, a primary transfer bias Vtr having the opposite polarity of toner is applied to the primary transfer roller 23. For example, the primary transfer bias Vtr is set to +1000V.

Drive Configuration of Photosensitive Drum 10 and Intermediate Transfer Belt The present exemplary embodiment employs a transfer method called slip transfer which performs image transfer while generating a circumferential speed difference between the photosensitive drum 10 and the intermediate transfer belt 24. In other words, the image conveyance speed (circumferential speed) differs between the photosensitive drum 10 and the intermediate transfer belt 24. The circumferential speed difference between the photosensitive drum 10 and the intermediate transfer belt 24 is set so that the photosensitive drum 10 rotates at higher speed than the intermediate transfer belt 24, for example, by about 0.1 to 1.0%. Setting may also be made so that the intermediate transfer belt 24 rotates at higher speed than the photosensitive drum 10.

Figure 4:
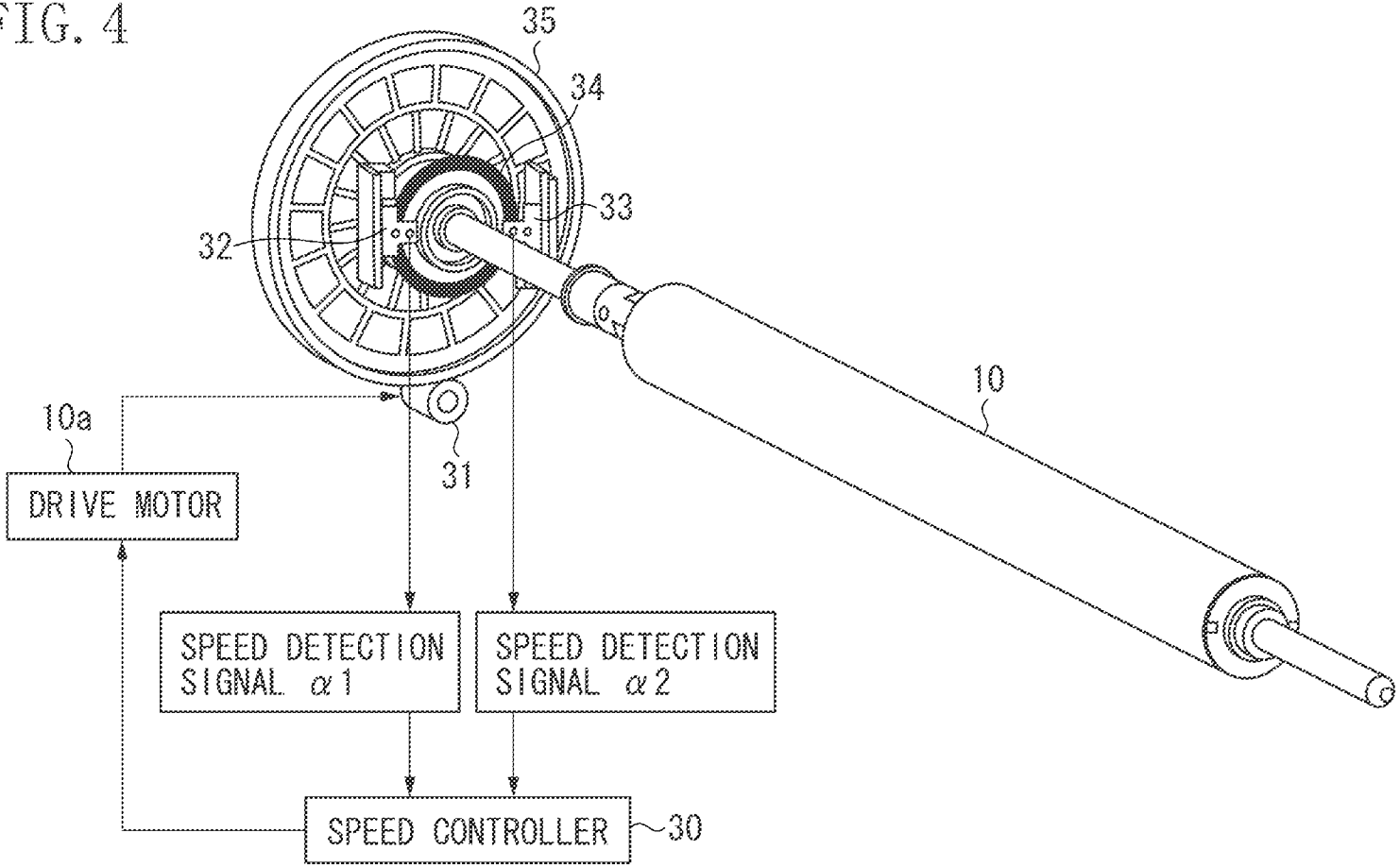
FIG. 4 is a perspective view schematically illustrating a configuration of a driving unit of a photosensitive drum.
Figure 5:
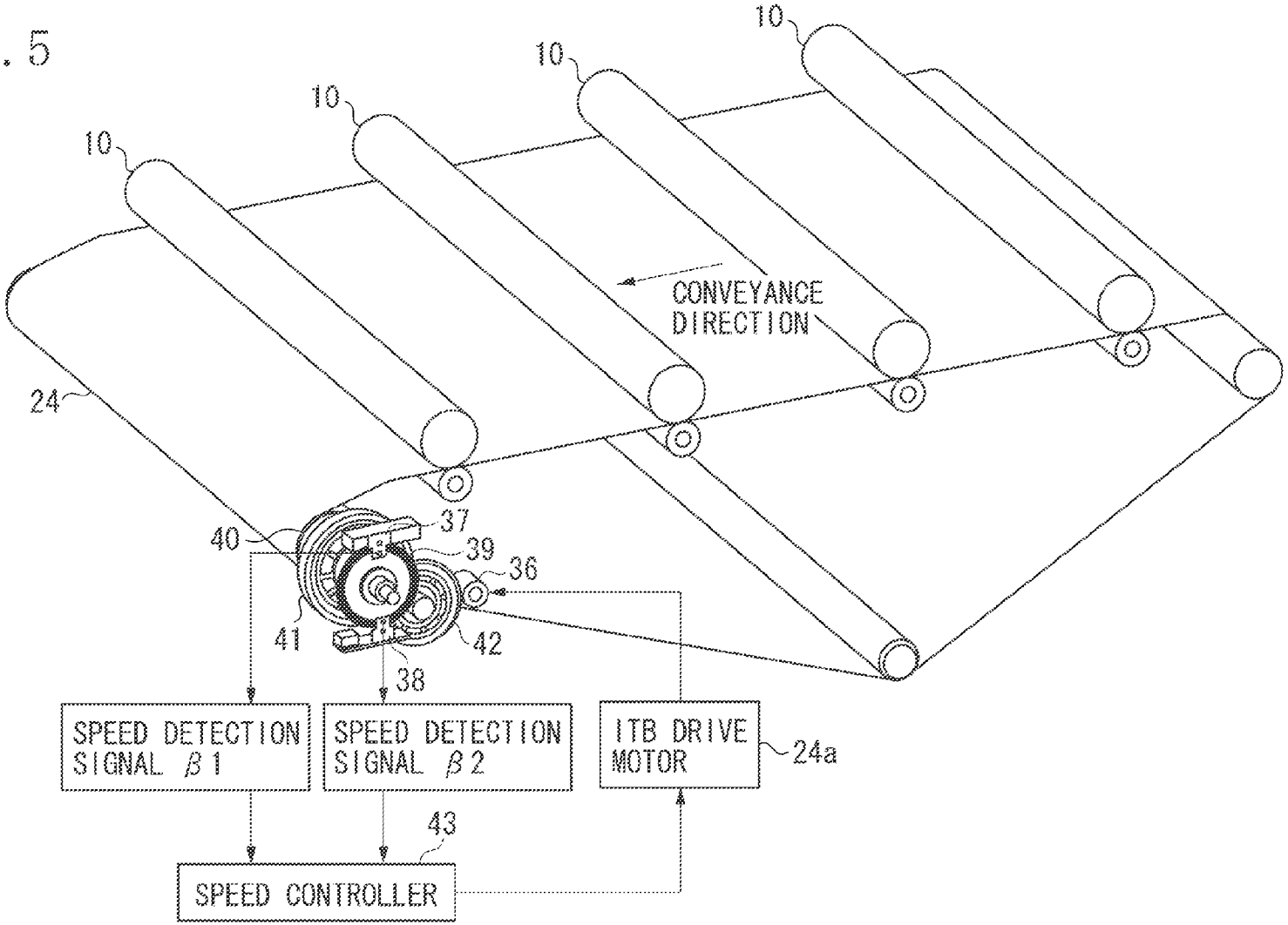
FIG. 5 is a perspective view schematically illustrating a configuration of a driving unit of an intermediate transfer belt.

Speed control of the photosensitive drum 10 and the intermediate transfer belt 24 will be described below with reference to FIGS. 4 and 5. First, speed control of the photosensitive drum 10 will be described below with reference to the driving unit of the photosensitive drum illustrated in FIG. 4.

FIG. illustrates a motor gear 31, speed detection sensors 32 and 33 as speed detection units, an encoder 34, and a drum drive gear 35. A drum drive motor 10*a* as a first driving unit rotatably drives the photosensitive drum 10 via the motor gear 31 and the drum drive gear 35. The encoder 34 is arranged on the rotary shaft of the photosensitive drum 10. The speed detection sensors 32 and 33 monitor the rotation of the encoder 34. The speed detection sensors 32 and 33 count the number of pulses corresponding to the rotational speed of the photosensitive drum 10, and feed the rotational speed of the photosensitive drum 10 back to a speed controller 30 as speed detection signals $\alpha$1 and $\alpha$2, respectively, thus performing speed control. The present exemplary embodiment performs speed control by using the average of the speeds obtained from the speed detection sensors 32 and 33. Eccentricity and deflection components of the encoder 34 are eliminated through this speed control. The number of speed detection sensors may be one.

Speed control of the intermediate transfer belt will be described below with reference to the driving unit of the intermediate transfer belt 24 illustrated in FIG. 5. FIG. 5 illustrates a motor gear 36, speed detection sensors 37 and 38 as speed detection units, an encoder 39, an intermediate transfer belt (ITB) drive roller 40, and ITB drive rollers 41 and 42.

When an ITB drive motor 24*a* (second driving unit 200) rotatably drives the ITB drive roller 40 via the motor gear 36 and the ITB drive gears 41 and 42, the intermediate transfer belt 24 (endless belt) is conveyed. The encoder 39 is arranged on the revolving shaft of the ITB drive roller 40. The speed detection sensors 37 and 38 monitors the rotation of the encoder 39. The speed detection sensors 37 and 38 count the number of pulses corresponding to the speed of the ITB drive roller 40, feed the rotational speed of the ITB drive roller 40 back to the speed controller 43 as speed detection signals $\beta$1 and $\beta$2, respectively, thus performing speed control. Eccentricity and deflection components of the encoder 39 are eliminated through this speed control. The number of speed detection sensors may be one.

During operation of the image forming apparatus 100, various load variations arise as disturbances to constant-speed rotations of the photosensitive drum 10 and the intermediate transfer belt 24. To improve the accuracy of image position (out of color registration) even if load variation occurs, the present exemplary embodiment performs control to maintain respective rotational speeds of the photosensitive drum 10 and the intermediate transfer belt 24 constant.

Load variations on the photosensitive drum 10 and the intermediate transfer belt 24 include, for example, a load variation arising at the contact portion between the photosensitive drum 10 and the intermediate transfer belt 24 rotating at different circumferential speeds. The load variation includes a frictional variation due to a minute stick slip between mutually rotating objects, and a frictional variation due to an increase in mutual grip force by an electrostatic adsorption force generated between the photosensitive drum 10 and the intermediate transfer belt 24 by the application of the primary transfer bias. Since toner serves as a lubricant between the photosensitive drum 10 and the intermediate transfer belt 24, the existence of toner has a large effect on frictional force variation.

Normal Image Forming Sequence

As described above, the development and transfer operations are performed by potential differences between members. Therefore, even a minute shift of timing for charging and driving each member makes toner fly on the photosensitive drum 10 at an unexpected timing. Accordingly, the normal image forming operation according to the present exemplary embodiment includes a sequence in which the above-described drive and bias application timing is adjusted.

Figure 6:
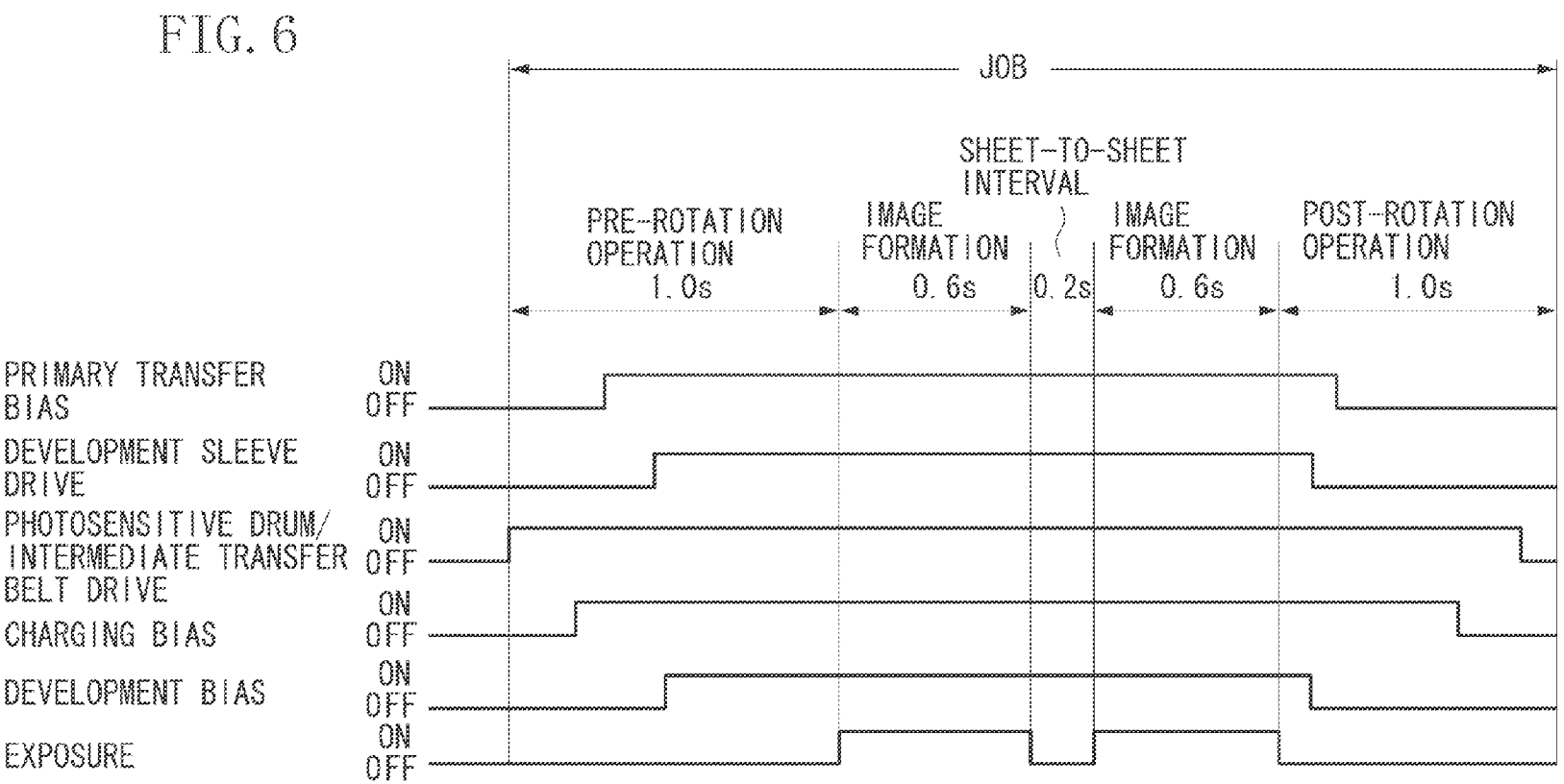
FIG. 6 is a timing chart illustrating operations of respective units at the time of normal image formation.

The normal image forming sequence according to the present exemplary embodiment will be described below with reference to FIG. 6. FIG. 6 illustrates a sequence of a job for forming two images in succession. In this example, four different time periods (pre-rotation, image formation, sheet-to-sheet interval, and post-rotation) will be described below. Pre-rotation refers to a time period during which drives and high voltages are turned ON prior to image formation. Image formation refers to a time period during which a latent image is actually formed on the photosensitive drum 10, and developed with toner to form a visible toner image. The sheet-to-sheet interval refers to a time period between consecutive image formation periods, during which image formation is not performed, in continuous image forming operation. Post-rotation refers to a time period during which the rotation of the photosensitive drum 10 is continued for a fixed time period following completion of image formation.

In pre-rotation, the photosensitive drum 10 and the intermediate transfer belt 24 is driven (ON), and the charging bias is applied (ON). Subsequently, when the charged portion on the photosensitive drum 10 reaches the primary transfer portion T1, the primary transfer bias is turned ON. Finally, the drive of the development sleeve 5 and the developing bias is turned ON.

In image formation, the charged photosensitive drum 10 is exposed (ON) to laser from the exposure unit 22 to form a latent image thereon, the latent image is developed by using toner on the development sleeve 5 to form a visible toner image at the development position, and the toner image is transferred onto the intermediate transfer belt 24 at the primary transfer portion T1. In the sheet-to-sheet interval, the exposure is turned OFF, and the other drives and bias is maintained in the same conditions as those in the image formation period.

In post-rotation, the exposure, the drive of the development sleeve 5, the developing bias, the primary transfer bias, and the charging bias are turned off in this order, and the photosensitive drum 10 and the intermediate transfer belt 24 are stopped (OFF).

Common Sequence when the Sheet-to-Sheet Interval is Prolonged

Figure 7:
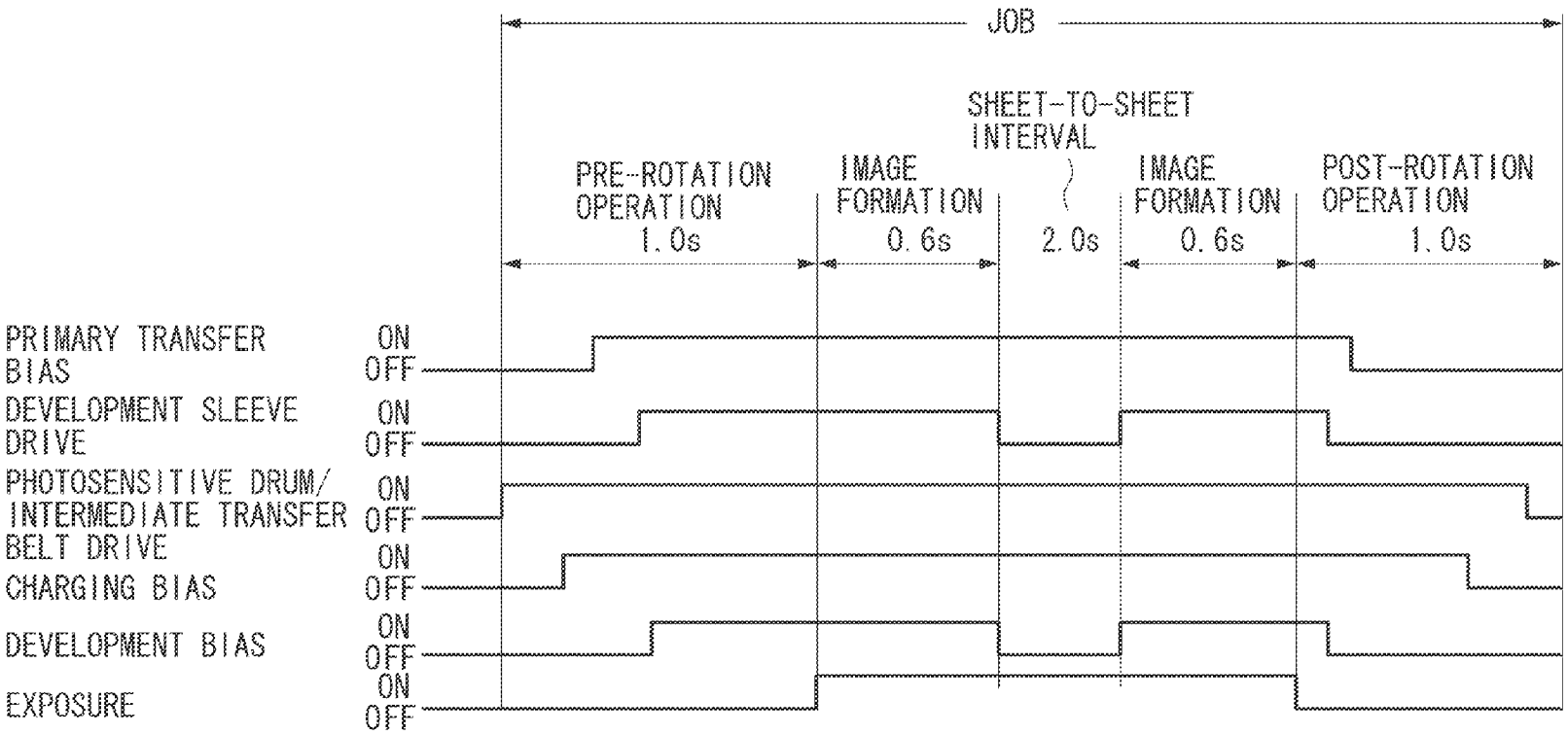
FIG. 7 is a timing chart illustrating operations of respective units at the time of image formation when various controls are performed in the sheet-to-sheet interval.

The following describe a common sequence to be executed when the sheet-to-sheet interval during two-sheet printing is prolonged by high-voltage control and switching between a plurality of sheet cassettes. Descriptions of pre-rotation, image formation, and post-rotation duplicated with the descriptions in FIG. 6 will be omitted. The sequence illustrated in FIG. 7 is largely different from the sequence illustrated in FIG. 6 in that the sheet-to-sheet interval between image formation periods serves as a control time period for performing various control not requiring an image forming operation, unlike the normal sheet-to-sheet interval. Thus, if there arises a control time period not requiring various control and the image forming operation, such as switching between a plurality of sheet cassettes, the drive of the development sleeve 5 and the developing bias are turned off, as illustrated in FIG. 7. The above-described sequence is intended to prevent developer deterioration as much as possible.

However, stopping the drive of the development sleeve 5 as described above may cause image defects, such as out of color registration and image unevenness. Image defects will be described below.

Occurrence Mechanism of Out of Color Registration and Image Unevenness Due to Development Sleeve STOP The following describes, with reference to FIGS. 8A, 8B, 10A, 10B, and 10C, the mechanism of the occurrence of out of color registration and image unevenness when the drive of the development sleeve 5 is stopped, as in the above-described sheet-to-sheet interval sequence illustrated in FIG. 7 and the structure discussed in Japanese Patent Application Laid-Open No. 2012-68390.

Figure 8A:
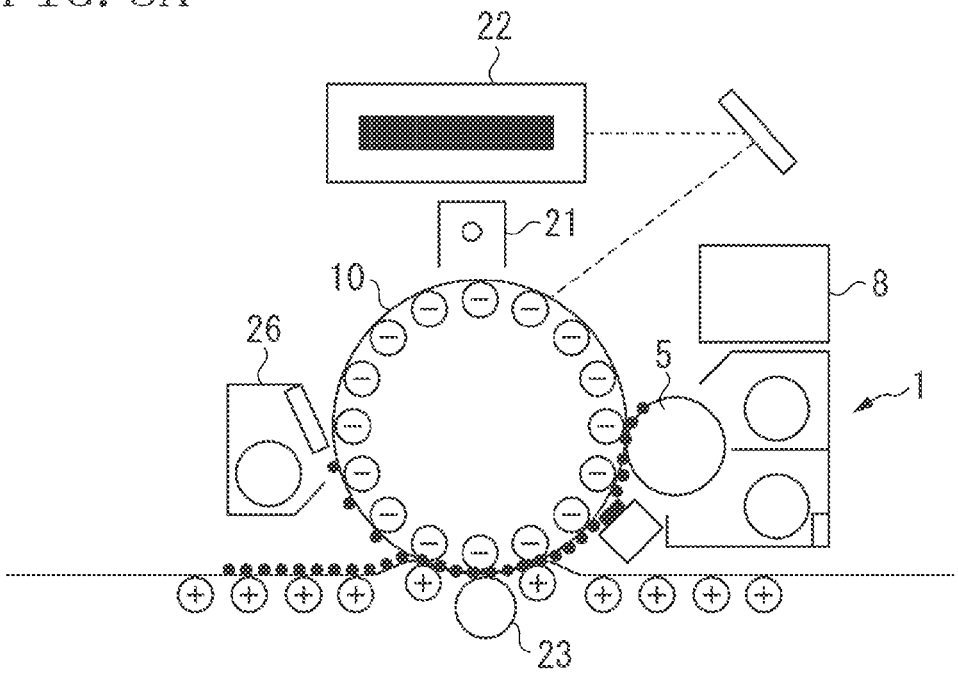
FIG. 8A schematically illustrates a state of the image forming unit when fogging toner exists.

As illustrated in FIG. 6, in the normal image forming sequence and the sheet-to-sheet interval thereof, the drive of the development sleeve 5 and the developing bias are constantly operating and therefore toner constantly exists on the photosensitive drum 10. At this timing, a minute amount of fogging toner exists on the photosensitive drum 10 also in areas without a printed image. Such a state is illustrated in FIG. 8A.

Figure 8B:
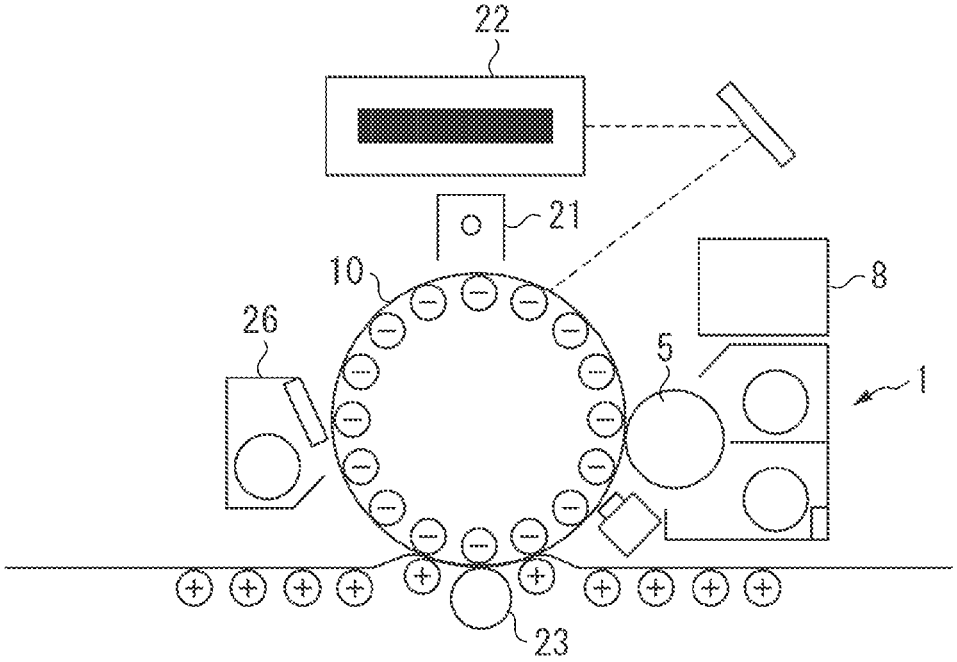
FIG. 8B schematically illustrates a state of the image forming unit when no fogging toner exists.

On the other hand, when the drive of the development sleeve is turned off through sheet-to-sheet interval control, as illustrated in FIG. 7, fogging toner on the photosensitive drum 10 disappears, as illustrated in FIG. 8B. When fogging toner on the photosensitive drum 10 disappears, the frictional force between the photosensitive drum 10 and the intermediate transfer belt 24 rapidly increases.

When the frictional force between the photosensitive drum 10 and the intermediate transfer belt 24 increases, the photosensitive drum 10 rotating at relatively higher speed than the intermediate transfer belt 24 strongly pulls the intermediate transfer belt 24 , rapidly decreasing the load on the ITB drive motor 24*a* driving the intermediate transfer belt 24. If this state continues for a certain fixed time period, the load on the ITB drive motor 24*a* decreases to a certain fixed level (becomes almost zero), the intermediate transfer belt 24 may become out of speed control.

Specifically, in a state where the photosensitive drum 10 pulls the intermediate transfer belt 24, the load on the ITB drive motor 24*a* decreases corresponding to increase of the load on the drum drive motor 10*a*. If the load on the ITB drive motor 24*a* decreases to a certain fixed level, the drive current of the ITB drive motor 24*a* becomes almost zero, resulting in a state where the ITB drive motor 24*a* does not work. In other words, the ITB drive motor 24*a* becomes out of speed control.

The above-described state will be described below with reference to FIG. 9. When the drive of the development sleeve 5 and the developing bias are turned off in sheet-to-sheet interval control, almost no toner is supplied onto the photosensitive drum 10. Then, when the time period A illustrated in FIG. 9 has elapsed since fogging toner on the photosensitive drum 10 disappeared, the toner between the photosensitive drum 10 and the intermediate transfer belt 24 also disappears. The time period A illustrated in FIG. 9 corresponds to the distance from the development sleeve 5 to the primary transfer roller 23 in the circumferential direction of the photosensitive drum 10.

Figure 9:
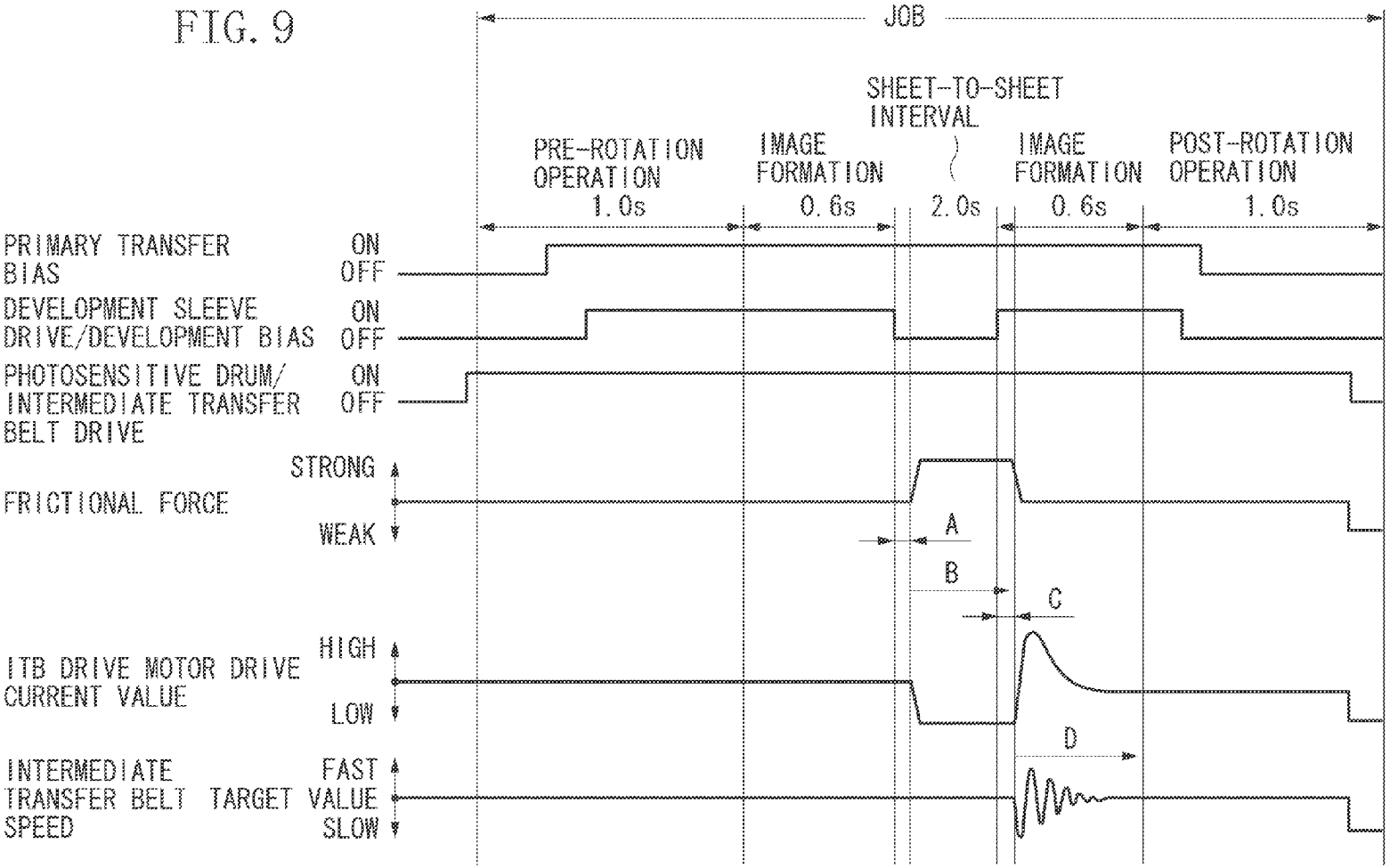
FIG. 9 is a timing chart illustrating operations of respective units at the time of image formation when no fogging toner exists.

When the time period A illustrated in FIG. 9 has elapsed and the toner between the photosensitive drum 10 and the intermediate transfer belt 24 disappears, the frictional force between the photosensitive drum 10 and the intermediate transfer belt 24 increases during the time period B illustrated in FIG. 9. During the time period B illustrated in FIG. 9, the state illustrated in FIG. 8A has changed to the state illustrated in FIG. 8B. In the meantime, since the photosensitive drum 10 rotating at relatively higher speed than the intermediate transfer belt 24 pulls the intermediate transfer belt 24, the drive current value of the ITB drive motor 24*a* decreases. Eventually, the drive current becomes almost zero. When the drive current value of the ITB drive motor 24*a* becomes almost zero, the ITB drive motor 24*a* does not work as described above, and the ITB drive motor 24*a* becomes out of speed control.

Then, when the drive of the development sleeve 5 and the developing bias are turned on again, fogging toner appears between the photosensitive drum 10 and the intermediate transfer belt 24 after the time period C illustrated in FIG. 9 has elapsed. Similar to the time period A illustrated in FIG. 9, the time period C illustrated in FIG. 9 corresponds to the distance from the development sleeve 5 to the primary transfer roller 23 in the circumferential direction of the photosensitive drum 10.

At a timing when fogging toner reaches again between the photosensitive drum 10 and the intermediate transfer belt 24, the frictional force between the photosensitive drum 10 and the intermediate transfer belt 24 decreases. Therefore, at this timing, a load will be generated in the ITB drive motor 24*a* again. If the ITB drive motor 24*a* is out of control during the time period B illustrated in FIG. 9, load variation occurs in which a load is generated again in the ITB drive motor 24*a*. As a result, speed variation of the ITB drive motor 24*a* will occur in the time period D and subsequent time periods illustrated in FIG. 9.

Figures 10A, 10B, 10C:
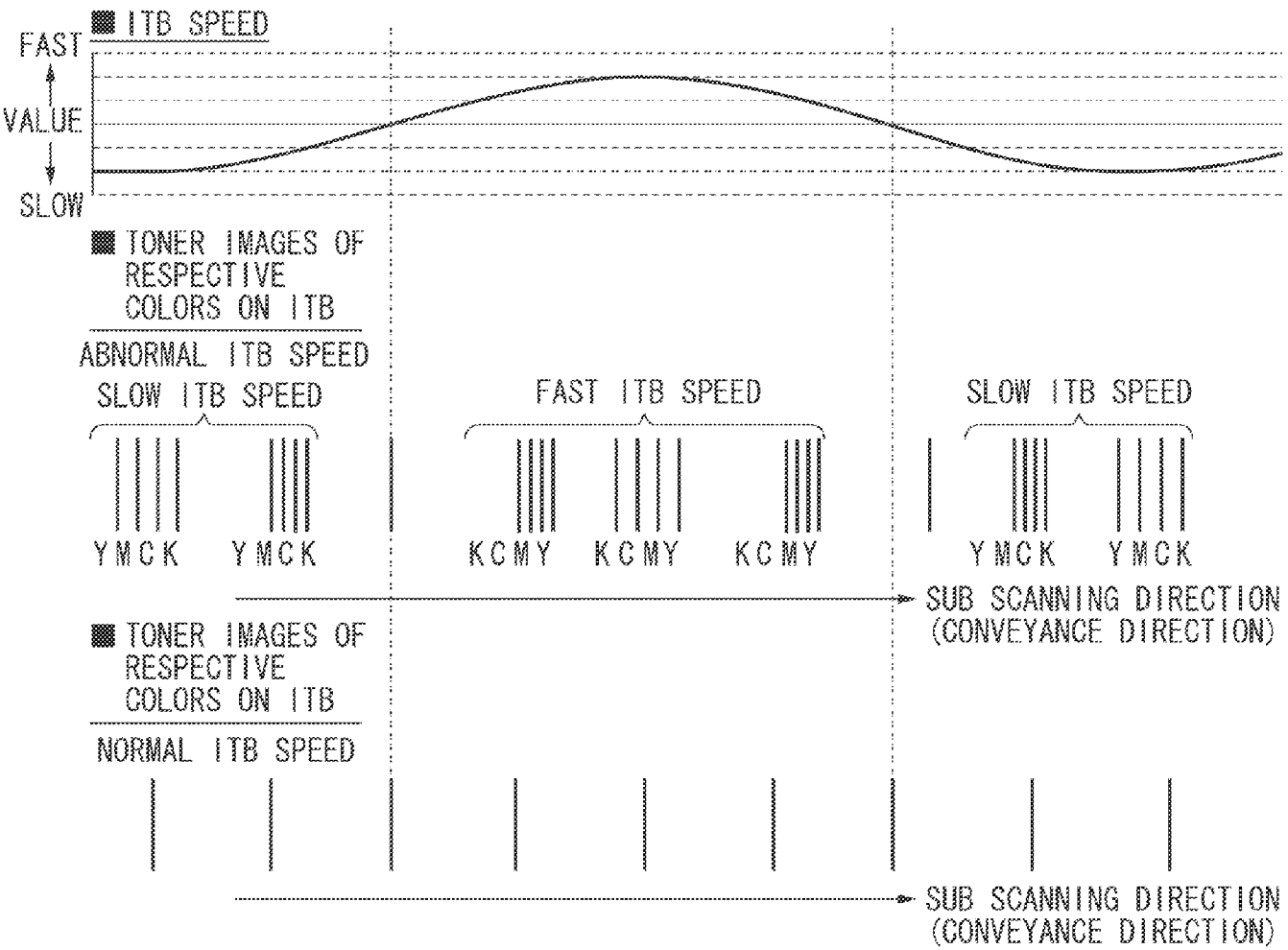
FIG. 10A illustrates speed variation of the intermediate transfer belt to describe out of color registration on the intermediate transfer belt due to speed variation.
FIG. 10B illustrates toner images when speed variation of the intermediate transfer belt arises, to describe out of color registration on the intermediate transfer belt due to speed variation.
FIG. 10C illustrates toner images when speed variation of the intermediate transfer belt does not arise, to describe out of color registration on the intermediate transfer belt due to speed variation.

FIGS. 10A to 10C are enlarged views illustrating partial speed variation and out of color registration at that time when speed variation occurs in the ITB drive motor 24*a*. As illustrated in FIGS. 10A to 10C, if the normal ITB speed changes to the abnormal ITB speed, out of color registration in which the order of Y, M, C, and K changes will occur according to speed variation of the intermediate transfer belt 24 accompanying speed variation of the ITB drive motor 24*a*. In the case of a monochrome image, an image unevenness results.

The above-described load variation may arise, in addition to the timing at which fogging toner enters between the photosensitive drum 10 and the intermediate transfer belt 24, by the above-described stick slip between the photosensitive drum 10 and the intermediate transfer belt 24. Specifically, in a state where no toner exists between the photosensitive drum 10 and the intermediate transfer belt 24, stick slip becomes easy to arise and so does the above-described load variation. Then, if these load variations arise when the ITB drive motor 24*a* is out of speed control, out of color registration and image unevenness will occur.

Sequence when the Development Sleeve Stops According to the Present Exemplary Embodiment In the present exemplary embodiment, the control unit 200 (FIG. 2) is capable of executing the developer bearing member stop mode in which the developer conveyance by the development sleeve 5 is stopped between images (in the sheet-to-sheet interval) in continuous image formation. In the developer bearing member stop mode, for example, the control unit 200 executes the following operation. First of all, as discussed in the above-described Japanese Patent Application Laid-Open No. 2012-68390, the control unit 200 stops the drive of the development sleeve 5 while continuing the drive of the conveying screws 3 and 4 in the sheet-to-sheet interval, to break down a developer's immobile layer in the development container 2. As illustrated in FIG. 7, the control unit 200 turns off the drive of the development sleeve 5 and the developing bias to prevent developer deterioration if there arises a control time not requiring image formation in the sheet-to-sheet interval. The rotation of the photosensitive drum 10 and the intermediate transfer belt 24 is continued also in the sheet-to-sheet interval.

When the control unit 200 resumes the developer conveyance by the development sleeve 5 from the above-described developer bearing member stop mode, the control unit 200 performs the following control to reduce variation in relative speed between the photosensitive drum 10 and the intermediate transfer belt 24. Specifically, in the developer bearing member stop mode, the control unit 200 changes the abutting state between the photosensitive drum 10 and the intermediate transfer belt 24 from that state at the normal image transfer time. The normal image transfer time refers to a timing for transferring onto the intermediate transfer belt 24 a toner image on the photosensitive drum 10 formed through the charging, exposure, and development processes.

In the present exemplary embodiment, the control unit 200 controls the power source 23*a* (for supplying the primary transfer bias) to lower the primary transfer bias applied to the primary transfer portion T in the developer bearing member stop mode below the primary transfer bias at the normal image transfer time. Specifically, altering the primary transfer bias changes the electrostatic adsorption force between the photosensitive drum 10 and the intermediate transfer belt 24, thus altering the abutting state.

Accordingly, the control unit 200 controls the motor 3*a* for driving the conveying screws 3 and 4, the motor 5*a* for driving the development sleeve 5, the power source 6 for applying the developing bias, and the power source 23*a* for supplying the primary transfer bias, in the developing device 1. Then, when performing the mode for breaking down a developer's immobile layer in the developer bearing member stop mode, the control unit 200 stops the drive of the development sleeve 5 while continuing the drive of the conveying screws 3 and 4 in the sheet-to-sheet interval. If there arises a control time not requiring image formation in the sheet-to-sheet interval, the control unit 200 turns off the drive of the development sleeve and the developing bias to prevent developer deterioration. Further, in the developer bearing member stop mode, the control unit 200 lowers the primary transfer bias applied to the primary transfer portion T1 below the primary transfer bias at the normal image transfer time. More specifically, in the developer bearing member stop mode, the control unit 200 does not apply (OFF) the primary transfer bias at the primary transfer portion T1.

Figure 11:
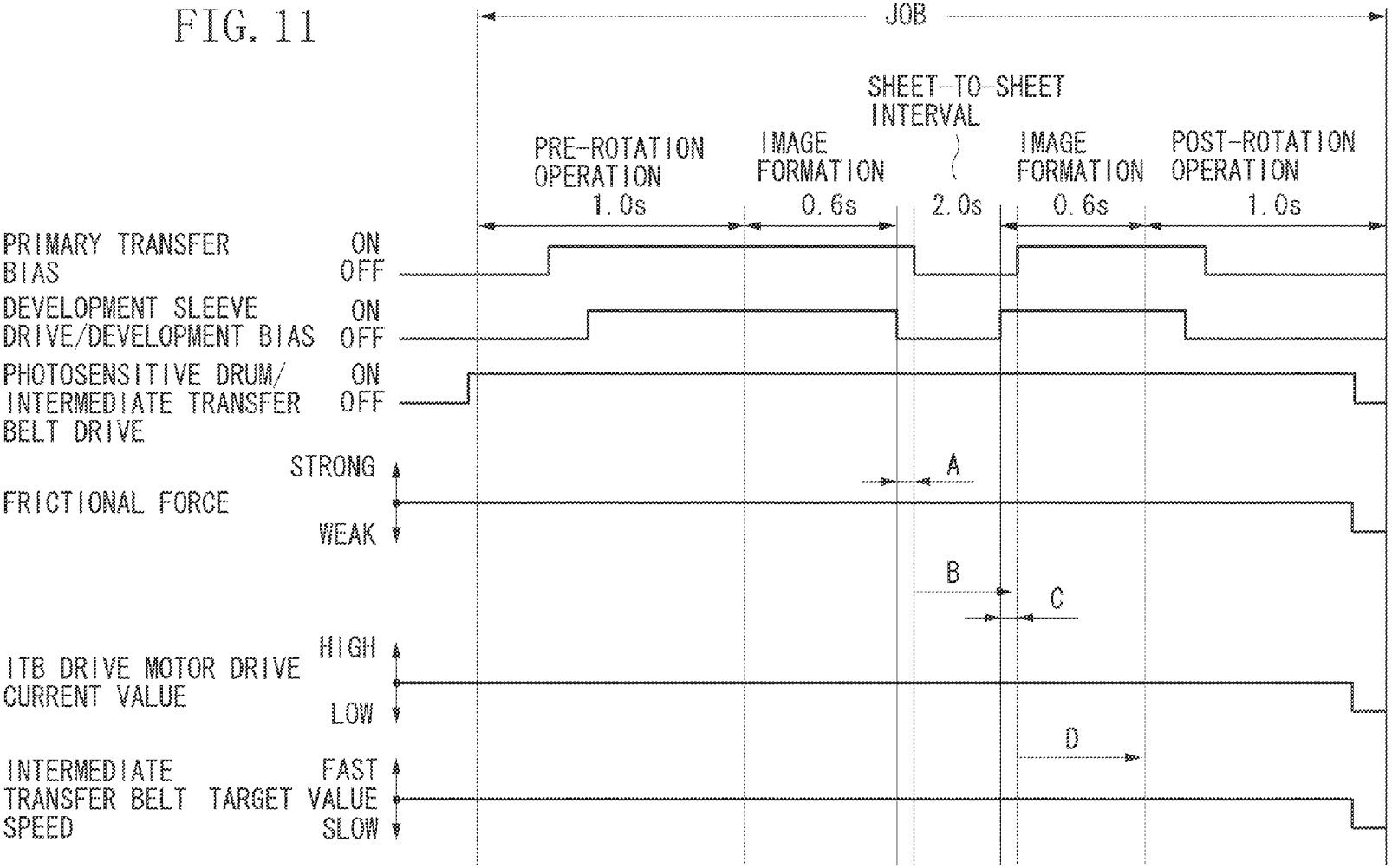
FIG. 11 is a timing chart illustrating operations of respective units of the image forming unit according to the first exemplary embodiment.

The sequence according to the present exemplary embodiment will be described below with reference to FIG. 11. As illustrated in FIG. 11, the control unit 200 turns off the primary transfer bias after the drive of the development sleeve 5 and the developing bias are turned off in the sheet-to-sheet interval. Then, when sheet-to-sheet interval control is completed and the drive of the development sleeve 5 and the developing bias are turned on, the control unit 200 turns on the primary transfer bias to apply the primary transfer bias at the normal image transfer time to the primary transfer portion T1. Then, the control unit 200 performs the following image formation.

The timing for changing (turning off) the primary transfer bias is within the time period A illustrated in FIG. 11, i.e., a time period since the drive of the development sleeve 5 and the developing bias are turned off until fogging toner between the photosensitive drum 10 and the intermediate transfer belt 24 is almost disappears. Specifically, the time period A refers to a time period at the same time or after the developer conveyance by the development sleeve 5 is stopped and at the same time or before the fogging toner between the photosensitive drum 10 and the intermediate transfer belt 24 almost disappears. A timing when at the same time or before the fogging toner between the photosensitive drum 10 and the intermediate transfer belt 24 almost disappears by stopping the developer conveyance by the development sleeve 5 refers to the following timing. An area on the photosensitive drum 10 which has passed a position facing the development sleeve 5 while the developer conveyance by the development sleeve 5 is stopped, is referred to as stop-time passing area. The control unit 200 changes the primary transfer bias at a timing when at the same time or before the downstream end of the stop-time passing area on the photosensitive drum 10 in the conveyance direction (the leading edge in the rotational direction) passes through between the photosensitive drum 10 and the intermediate transfer belts 24. In other words, the control unit 200 changes the primary transfer bias at a timing when at the same time or before a position of the photosensitive drum 10, having faced the development sleeve 5 when the developer conveyance by the development sleeve 5 was stopped, passes through between the photosensitive drum 10 and the intermediate transfer belts 24.

Turning off the primary transfer bias within such a time period enables reducing load variation, and is the most desirable. Specifically, in the relevant time period, fogging toner changes from the image forming state to disappearance state. Therefore, turning off the primary transfer bias within the period enables, at almost the same timing, increasing the frictional force with disappearing fogging toner, and decreasing the frictional force with decreased electrostatic adsorption force. As a result, mutual frictional variations negate each other to reduce frictional force variation.

However, the timing for changing the primary transfer bias is not limited thereto. For example, if the timing for changing the primary transfer bias is close to the timing for stopping the drive of the development sleeve 5 or the timing at which fogging toner between the photosensitive drum 10 and the intermediate transfer belt 24 almost disappears, the effect of reduction in frictional force variation can be obtained.

On the other hand, the control unit 200 turns on the primary transfer bias, i.e., resumes the primary transfer bias to the state at the normal image transfer time, after the time period B illustrated in FIG. 11, i.e., at a timing after fogging toner reaches between the photosensitive drum 10 and the intermediate transfer belts 24. Specifically, the control unit 200 turns on the primary transfer bias at the same time or from that time onward when fogging toner reaches between the photosensitive drum 10 and the intermediate transfer belt 24 by resuming the once stopped developer conveyance by the development sleeve 5. In other words, the control unit 200 turns on the primary transfer bias at the same time or from that time onward when a position of the photosensitive drum 10, having faced the development sleeve 5 when the once stopped developer conveyance by the development sleeve 5 was resumed, reaches between the photosensitive drum 10 and the intermediate transfer belt 24. Of course, the control unit 200 turns on the primary transfer bias at a timing satisfying the above-described condition, and after the developer conveyance by the development sleeve 5 is resumed, and before an image formed first on the photosensitive drum 10 reaches between the photosensitive drum 10 and the intermediate transfer belt 24.

Turning on the primary transfer bias in such a time period enables reducing load variation, and is the most desirable. Specifically, turning on the primary transfer bias after fogging toner reaches between the photosensitive drum 10 and the intermediate transfer belt 24 enables preventing the effect of the electrostatic adsorption force by the primary transfer bias, thus reducing frictional force variation.

However, the timing for resuming the primary transfer bias to the state at the normal image transfer time is not necessarily limited to the above-described timing. For example, if the timing for resuming the primary transfer bias to the state at the normal image transfer time is close to the ON timing of the development sleeve 5 and developing bias to a timing not affecting the following image, similar effects to those described above can be obtained.

In the present exemplary embodiment, the control unit 200 sequentially performs the above-described primary transfer bias ON/OFF sequence for each image forming unit. Specifically, the timing of toner image formation and the timing of the sheet-to-sheet interval differ for each image forming unit, i.e., these timings becomes later on the more downstream side in the rotational direction of the intermediate transfer belt 24. Therefore, the control unit 200 executes the above-described sequence at a timing different for each image forming unit. In the present exemplary embodiment, since each image forming unit applies the primary transfer bias from a different power source 23*a*, as described above, the control unit 200 can apply the primary transfer bias at a timing different for each image forming unit.

If a common power source is used to apply the primary transfer bias to the primary transfer portions of all of the image forming units 200, the control unit 200 preferably turns the primary transfer bias on and off in the following way. First of all, the control unit 200 can synchronize the timing for turning off the primary transfer bias with the timing of an image forming unit at which fogging toner between the photosensitive drum 10 and the intermediate transfer belt 24 first disappears. On the other hand, the control unit 200 can synchronize the timing for turning ON the primary transfer bias with the timing at which fogging toner reaches between the photosensitive drum 10 and the intermediate transfer belt 24 in all of the image forming units.

In the present exemplary embodiment, when the control unit 200 resumes the developer conveyance, the control unit 200 changes the abutting state between the photosensitive drum 10 and the intermediate transfer belt 24 from that state at the normal image transfer time in the developer bearing member stop mode so as to reduce variation in relative speed between the photosensitive drum 10 and the intermediate transfer belt 24. Specifically, the control unit 200 turns off the primary transfer bias in the developer bearing member stop mode. Accordingly, even when the control unit 200 resumes the once stopped developer conveyance by the development sleeve 5, it is possible to reduce load variation of the photosensitive drum 10 or the intermediate transfer belts 24, whichever is rotating at lower speed (the intermediate transfer belt 24 in the present exemplary embodiment). As a result, the possibility of image unevenness and out of color registration due to speed variation of a member rotating at lower speed (the intermediate transfer belt 24) can be reduced.

Figure 12:
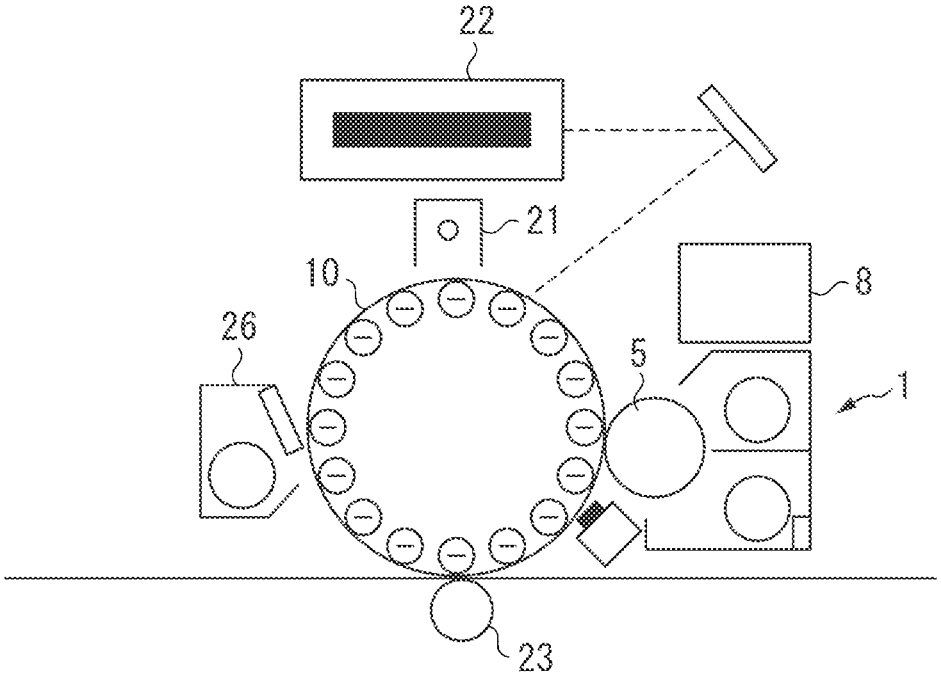
FIG. 12 is a schematic view illustrating the image forming unit in the sheet-to-sheet interval illustrated in FIG. 11.

Specifically, even if fogging toner between the photosensitive drum 10 and the intermediate transfer belt 24 disappears, decreasing the electrostatic adsorption force by the primary transfer bias enables reducing the frictional force between the photosensitive drum 10 and the intermediate transfer belt 24. More specifically, in the developer bearing member stop mode, fogging toner disappears, as illustrated in FIG. 8B, and the frictional force between the photosensitive drum 10 and the intermediate transfer belt 24 increases. On the other hand, in the present exemplary embodiment, the control unit 200 turns off the primary transfer bias, as illustrated in FIG. 12, to reduce the frictional force, thus relatively reducing frictional force variation.

If the frictional force variation is reduced in this way, the drive current of the ITB drive motor 24*a* does not decrease, as illustrated in FIG. , preventing the ITB drive motor 24*a* from becoming out of speed control. Specifically, even if fogging toner disappears, the frictional force between the photosensitive drum 10 and the intermediate transfer belt 24 does not rapidly increase, enabling stable speed control of the ITB drive motor 24*a*. As a result, when the control unit 200 resumes the developer conveyance, variation in relative speed between the photosensitive drum 10 and the intermediate transfer belt 24 is reduced, thus preventing out of color registration and image unevenness due to speed variation after the time period D illustrated in FIG. 9.

According to the present exemplary embodiment, even if the control unit 200 stops the development sleeve during rotation of the photosensitive drum 10 and the intermediate transfer belt 24, the control unit 200 can perform stable rotational speed control of the photosensitive drum 10 and the intermediate transfer belt 24, thus providing high-definition images without out of color registration.

Another Example of the First Exemplary Embodiment

Although, in the first exemplary embodiment, the control unit 200 turns off the primary transfer bias in the developer bearing member stop mode, the control unit 200 may only lower the primary transfer bias below the primary transfer bias at the normal image transfer time. Specifically, lowering the primary transfer bias below the primary transfer bias at the normal image transfer time enables lowering the electrostatic adsorption force between the photosensitive drum 10 and the intermediate transfer belt 24. Thus, similar effects to those described above can be obtained. The timing chart is illustrated in FIG. 13.

Figure 13:
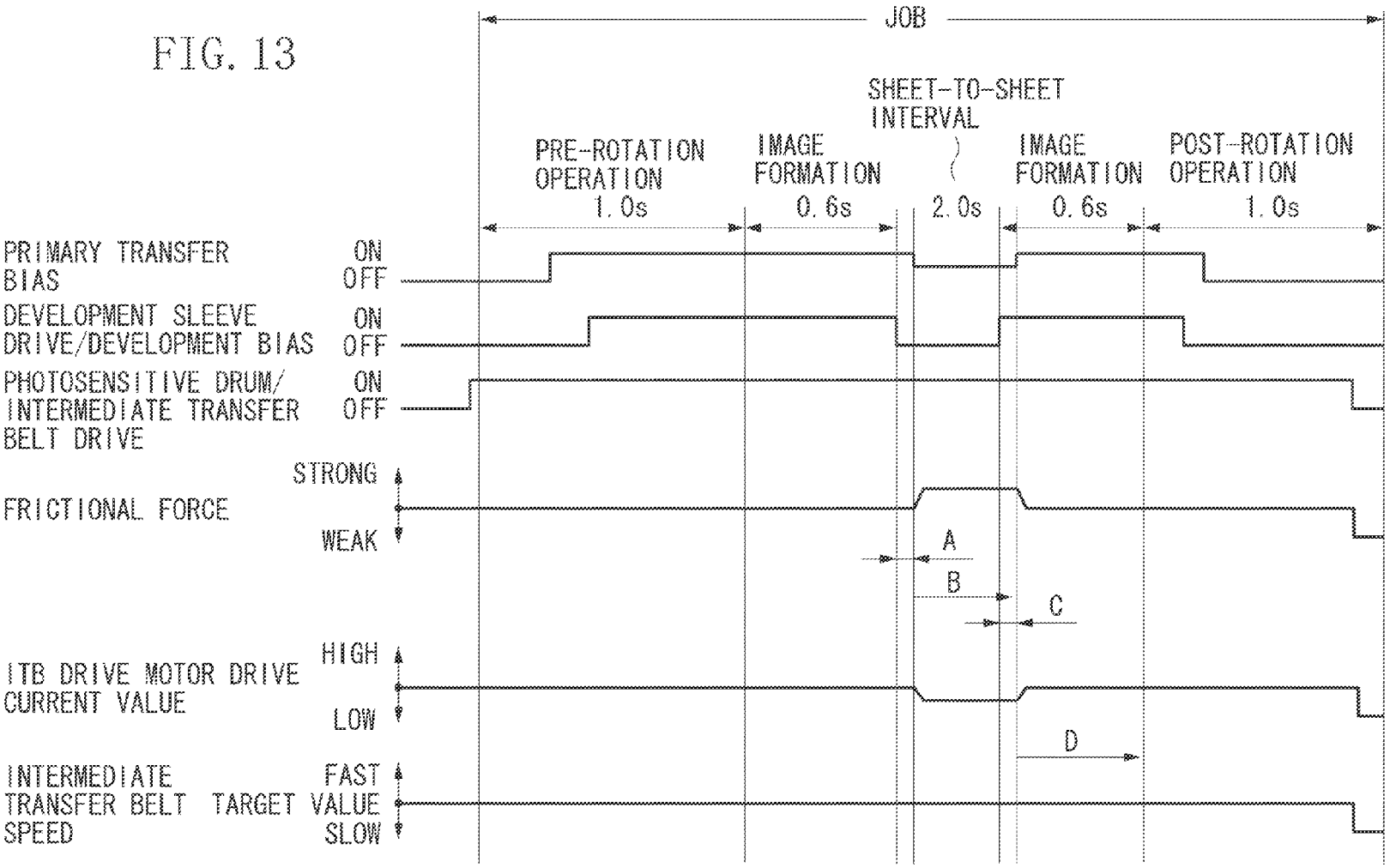
FIG. 13 is a timing chart illustrating operations of respective units of another example of the image forming unit according to the first exemplary embodiment.

As illustrated in FIG. 13, speed variation can be sufficiently prevented although frictional variation does not disappear. Other details are similar to those of the first exemplary embodiment except that the primary transfer bias is lowered instead of being turned OFF, descriptions thereof will be omitted.

Although, in the developer bearing member stop mode, the control unit 200 can turn off or lowers the primary transfer bias below the primary transfer bias at the normal image transfer time for all of the image forming units, the control unit 200 may also turn off or lower the primary transfer bias below the primary transfer bias at the normal image transfer time for at least one image forming unit 200.

Although, in the first exemplary embodiment, a system is described to include the photosensitive drum 10 rotating at relatively higher speed than the intermediate transfer belt 24, a similar phenomenon may occur in a system including the intermediate transfer belt 24 rotating at higher speed than the photosensitive drum 10. Accordingly, the control unit 200 performs similar control to obtain similar effects to those described above.

Figure 14:
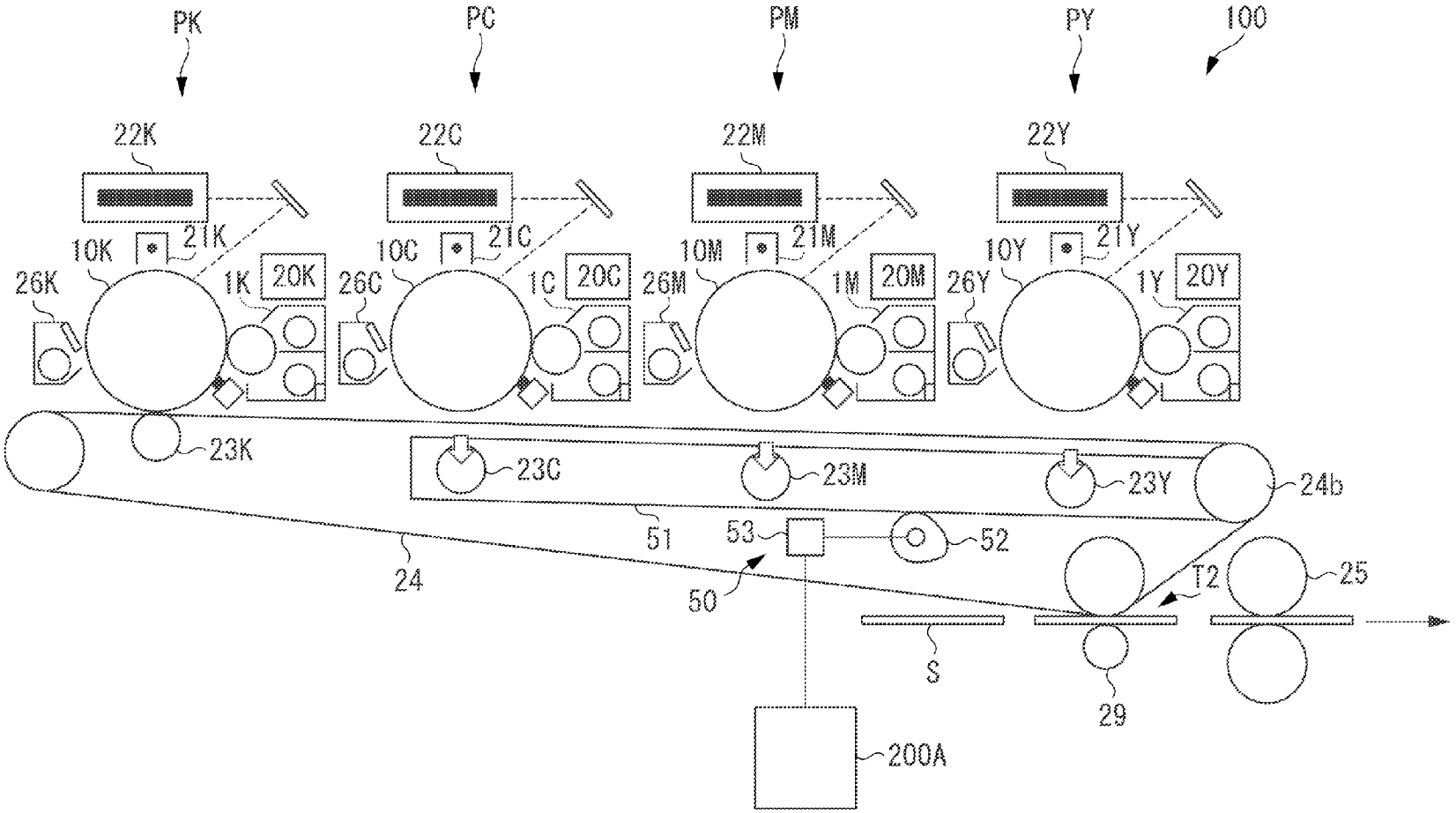
FIG. 14 is a schematic view illustrating an image forming apparatus according to a second exemplary embodiment of the present invention.

A second exemplary embodiment of the present invention will be described below with reference to FIG. 14. In the present exemplary embodiment, when the control unit 200 turns off the drive of the development sleeve in the sheet-to-sheet interval control described in the first exemplary embodiment, the control unit 200 separates the primary transfer rollers 23 from the photosensitive drums 10. In the present exemplary embodiment, in sheet-to-sheet interval control, the control unit 200 separates the primary transfer rollers for Y, M, and C (23Y, 23M, and 23C) from the photosensitive drums 10Y, 10M, and 10C, respectively, to change from the full color mode to the monochrome mode, as illustrated in FIG. 14. In this state, the photosensitive drums 10Y, 10M, and 10C are not in contact with the intermediate transfer belt 24.

Specifically, an image forming apparatus 100A according to the present exemplary embodiment can execute the full color mode and the monochrome mode. The image forming apparatus 100A performs image formation by using all colors (Y, M, C, and K) in the full color mode, and performs monochrome image formation by using monochromatic black (K) in the monochrome mode. In the full color mode, the primary transfer rollers 23Y, 23M, 23C, and 23K of all of the image forming units abut on the photosensitive drums 10Y, 10M, 10C, and 10K, respectively, via the intermediate transfer belt 24. In the monochrome mode, only the primary transfer roller 23K of the image forming unit K abut on the photosensitive drum 10K via the intermediate transfer belt 24, and the primary transfer rollers 23Y, 23M, and 23C of other image forming units separate from the intermediate transfer belt 24. Thus, the control unit 200 can stop the drive of the image forming units not used for image formation, preventing abrasion of each member.

To separate the primary transfer rollers 23Y, 23M, and 23C from the photosensitive drums 10Y, 10M, and 10C, respectively, in the monochrome mode in this way, the image forming apparatus 100A according to the present exemplary embodiment has the following configuration. Specifically, primary transfer portions T1Y, T1M, and T1C include the primary transfer rollers 23Y, 23M, and 23C, respectively, and an abutting/separating mechanism 50 (abutting/separating unit).

The primary transfer rollers 23Y, 23M, and 23C are arranged to abut on and separate from the photosensitive drum 10Y, 10M, and 10C, respectively, via the intermediate transfer belt 24. The primary transfer rollers 23 abuts on the photosensitive drums 10 at the normal image transfer time. More specifically, the primary transfer rollers 23Y, 23M, and 23C are arranged on a frame 51 rotatably supported at a fixed portion of the main body of the image forming apparatus 100A. The primary transfer rollers 23Y, 23M, and 23C are rotatably supported via springs urging toward the photosensitive drum 10Y, 10M, and 10C, respectively. The frame also supports a tension roller 24*b* arranged on the upstream side of the primary transfer roller Y out of the tension rollers for stretching the intermediate transfer belt 24.

The abutting/separating mechanism 50 causes the primary transfer rollers 23Y, 23M, and 23C to abut on or separate from the photosensitive drum 10Y, 10M, and 10C, respectively, via the intermediate transfer belt 24. The abutting/separating mechanism includes an eccentric cam 52 abutting on the frame51, and a motor 53 for rotatably driving the eccentric cam 52. The frame 51 is urged toward the eccentric cam 52 by a urging member, such as a spring (not illustrated). A control unit 200A rotates the eccentric cam 52 via the motor 53 to rotate the frame 51. The frame 51 supports, as described above, the primary transfer rollers 23Y, 23M, and 23C, and the tension roller 24*b*. Therefore, when the frame 51 rotates, the intermediate transfer belt 24 abuts on and separates from the photosensitive drum 10Y, 10M, and 10C, together with the primary transfer rollers 23 , 23M, and 23C, respectively.

In the present exemplary embodiment, the control unit 200A controls the abutting/separating mechanism 50 to separate the primary transfer rollers 23Y, 23M, and 23C from the intermediate transfer belt 24 in the developer bearing member stop mode to change the abutting state between the photosensitive drums 10Y, 10M, and 10C and the intermediate transfer belt 24. Specifically, in the sheet-to-sheet interval in the full color mode, the control unit 200 sets the monochrome mode to make the photosensitive drums 10Y, 10M, and 10C and the intermediate transfer belt 24 not in contact with each other.

Thus, in the developer bearing member stop mode in the full color mode, the control unit 200 causes the photosensitive drums 10Y,10 M, and 10C and the intermediate transfer belt 24 not to be in contact with each other. This means that the frictional force between the photosensitive drums 10Y, 10M, and 10C and the intermediate transfer belt 24 illustrated in FIG. 8B does not primarily exist. Accordingly, a frictional force arises between the photosensitive drum 10 and the intermediate transfer belt 24 only in the image forming unit K. As a result, since the frictional force totally decreases, similar effects to those in the first exemplary embodiment can be obtained.

The timing for separating the primary transfer rollers 23, and the timing for causing the primary transfer rollers 23 to abut on again to perform image formation after the developer bearing member stop mode ends are similar to the timings according to the first exemplary embodiment. For example, the most effective timing for separating the primary transfer rollers 23 is a time period from the time when the drive of the development sleeve 5 and the developing bias are turned off to the time when fogging toner between the photosensitive drum 10 and the intermediate transfer belt 24 disappears. The most effective timing for resuming from the separated state is the timing when and after fogging toner reaches between the photosensitive drum 10 and the intermediate transfer belt 24.

The abutting/separating operation of the primary transfer rollers 23 may be performed based on the combination of the motor 53 and the eccentric cam 52, as described above, the configuration is not limited thereto. For example, the frame 51 may also be moved by an actuator, such as a linear motor. Alternatively, each of the primary transfer rollers 23 may also be separately moved by a cam or an actuator.

According to the present exemplary embodiment, the abutting/separating operation of the primary transfer rollers 23 is described to switch between the full color mode and the monochrome mode, the configuration is not limited thereto. It goes without saying that similar effects can also be acquired by separating the primary transfer roller 23 for only one color or the primary transfer rollers 23 for all colors. Specifically, in the developer bearing member stop mode, the control unit 200 can change the abutting state between the photosensitive drum 10 and the intermediate transfer belt 24 by separating the primary transfer roller 23 for at least one image forming unit out of the plurality of image forming units. Other structures and operations are similar to those in the first exemplary embodiment.

In addition to separating the primary transfer rollers 23 in the developer bearing member stop mode as in the present exemplary embodiment, the control unit 200 can also lower the primary transfer bias as in the first exemplary embodiment. Specifically, in the monochrome mode, the control unit 200 may also lower the primary transfer bias applied to the primary transfer roller 23K for black (K). In short, the present exemplary embodiment can be implemented suitably in combination with the first exemplary embodiment.

A third exemplary embodiment of the present invention will be described below with reference to FIG. 15, referring to FIGS. 1, 2, 4, and 5. In the present exemplary embodiment, when the control unit 200 turns off the drive of the development sleeve 5 in sheet-to-sheet interval control described in the first exemplary embodiment, the control unit 200 changes the speed settings for the photosensitive drum 10 and the intermediate transfer belt 24 so as to reduce the circumferential speed difference therebetween. Specifically, the control unit 200 controls at least either one of the drum 10 drive motor 10*a* (first driving unit) and the ITB drive motor 24*a* (second driving unit). Then, the control unit 200 reduces the relative speed difference between the photosensitive drum 10 and the intermediate transfer belt 24 in the developer bearing member stop mode below the relative speed difference at the normal image transfer time. Specifically, in the developer bearing member stop mode, the control unit 200 changes the relative speed between the photosensitive drum 10 and the intermediate transfer belt 24 from the relative speed at the normal image transfer time.

Figure 15:
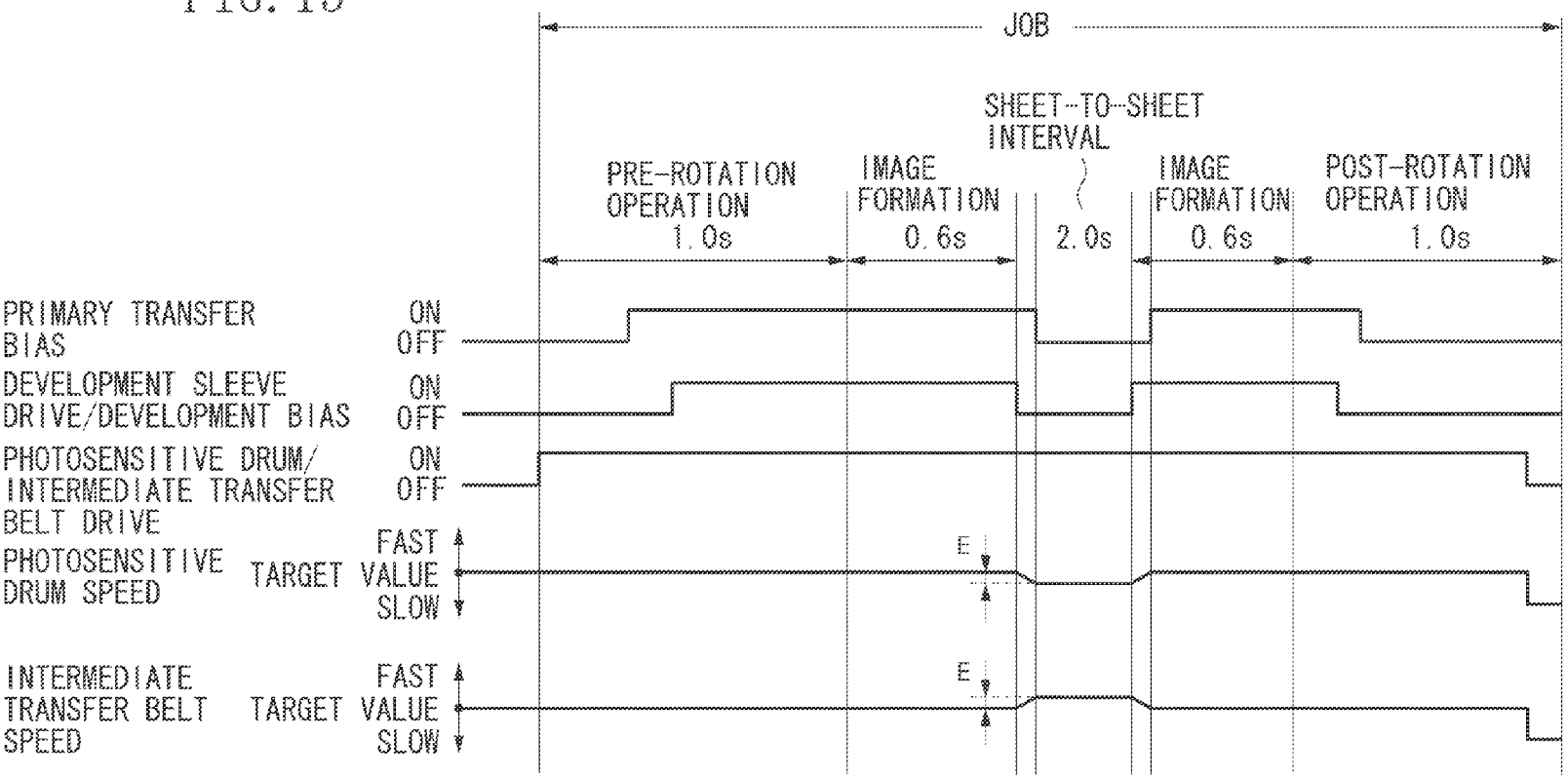
FIG. 15 is a timing chart illustrating operations of respective units of an image forming unit according to a third exemplary embodiment of the present invention.

In the present exemplary embodiment, in the sheet-to-sheet interval, the control unit 200 decreases the circumferential speed of the photosensitive drum 10 rotating at relatively higher speed, and increases the circumferential speed of the intermediate transfer belt 24 rotating at relatively lower speed so as to reduce the circumferential speed difference therebetween, as illustrated in FIG. 15. Accordingly, the control unit 200 can change the speed settings of the speed controllers 30 and 43 illustrated in FIGS. 4 and 5. In sheet-to-sheet interval control, even either one of the speed settings of the photosensitive drum 10 and the intermediate transfer belt 24 may be changed as long as the relative circumferential speed difference changes.

The timing for changing the speed settings of the photosensitive drum 10 and the intermediate transfer belt 24, and the timing for resuming the speed settings to perform image formation after the developer bearing member stop mode ends are similar to the timings according to the first exemplary embodiment. For example, the most effective timing for changing the speed settings of the photosensitive drum 10 and the intermediate transfer belt 24 is a time period from the time when the drive of the development sleeve 5 and the developing bias are turned off to the time when fogging toner between the photosensitive drum 10 and the intermediate transfer belt 24 disappears. The most effective timing for resuming the speed settings of the photosensitive drum 10 and the intermediate transfer belt 24 is a timing when and after fogging toner reaches again between the photosensitive drum 10 and the intermediate transfer belt 24.

It is most effective to change the speed settings, i.e., the target speed values illustrated in FIG. 15E, so that the circumferential speed difference between the photosensitive drum 10 and the intermediate transfer belt 24 becomes just 0.

Further, the timing for changing the speed settings and the timing for resuming the speed settings may be identical for all of the image forming units, or different for each image forming unit. In short, the control unit 200 may set the timings as required considering whether the above-described fogging toner exists between the photosensitive drum 10 and the intermediate transfer belt 24. For example, when changing these timings for each image forming unit, these timings becomes later on the more downstream side in the rotational direction of the intermediate transfer belt 24 since the timing of toner image formation and the timing of sheet-to-sheet interval differ for each image forming unit. Alternatively, when equalizing these timings for all of the image forming units, the control unit 200 can make setting in the following way. First of all, the control unit 200 can synchronize the timing for changing the speed settings with the timing of an image forming unit at which fogging toner between the photosensitive drum 10 and the intermediate transfer belt 24 first disappears. On the other hand, the control unit 200 can synchronize the timing for resuming the speed settings with the timing at which fogging toner reaches between the photosensitive drum 10 and the intermediate transfer belt 24 in all of the image forming units.

Thus, in the developer bearing member stop mode, reducing or zeroing the circumferential speed difference between the photosensitive drum 10 and the intermediate transfer belt 24 in this way prevents the photosensitive drum 10 and the intermediate transfer belt 24 from pulling each other, decreasing frictional force variation. Thus, the ITB drive motor 24*a* does not become out of control, as described in the first exemplary embodiment for example. Accordingly, the control unit 200 can stably rotate the intermediate transfer belt 24 in the image formation period, obtaining similar effects to those in the first exemplary embodiment. Other structures and operations are similar to those in the first exemplary embodiment.

In addition to reducing or zeroing the circumferential speed difference between the photosensitive drum 10 and the intermediate transfer belt 24 in the developer bearing member stop mode as in the present exemplary embodiment, the control unit 200 may also lower the primary transfer bias as in the first exemplary embodiment. As in the second exemplary embodiment, in the monochrome mode, the control unit 200 may also reduce or zero the circumferential speed difference between the photosensitive drum 10K for black (K) and the intermediate transfer belt 24. In short, the present exemplary embodiment can be implemented suitably in combination with the first and second exemplary embodiments.

In the developer bearing member stop mode, the control unit 200 may also stop the drive of the photosensitive drum 10 and the intermediate transfer belt 24 to change the state of the relative speed between the photosensitive drum 10 and the intermediate transfer belt 24. More specifically, in the developer bearing member stop mode, the control unit 200 may also once stop the drum drive motor 10*a* and the ITB drive motor 24*a* to primarily prevent the image from being affected by speed variation, thus preventing out of color registration and image unevenness.

Figure 16:
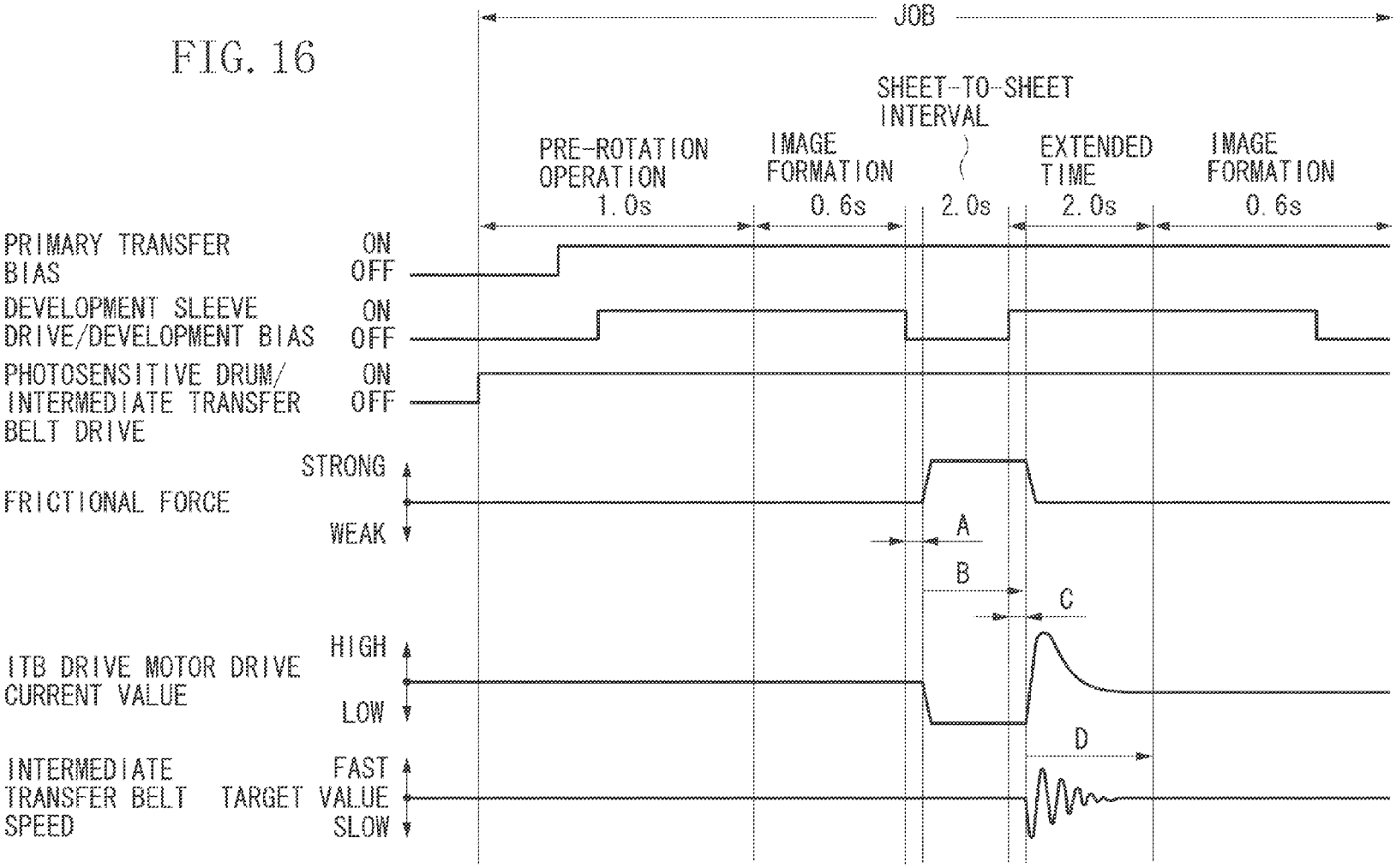
FIG. 16 is a timing chart illustrating operations of respective units of an image forming unit according to a fourth exemplary embodiment of the present invention.

A fourth exemplary embodiment of the present invention will be described below with reference to FIG. 16, referring to FIGS. 1 and 2. In the present exemplary embodiment, when the control unit 200 turns off the drive of the development sleeve 5 in sheet-to-sheet interval control described in the first exemplary embodiment, the control unit 200 extends the sheet-to-sheet interval until speed variation of the intermediate transfer belt 24 described in FIG. 9 settles down. Specifically, the control unit 200 executes the developer bearing member stop mode, resumes the developer conveyance by the development sleeve 5, and, when a predetermined time period has elapsed since fogging toner reached between the photosensitive drum 10 and the intermediate transfer belt 24, performs image formation after the sheet-to-sheet interval. In other words, when the predetermined time period has elapsed since a position of the photosensitive drum 10, having faced the development sleeve 5 when the developer conveyance by the development sleeve 5 was resumed, reached between the photosensitive drum 10 and the intermediate transfer belt 24, the control unit 200 performs image formation after the sheet-to-sheet interval. More specifically, the control unit 200 extends the sheet-to-sheet interval until speed variation of the intermediate transfer belt 24 described in FIG. 9 by a predetermined time period (extended time), and performs the first image formation after the developer conveyance by the development sleeve 5 is resumed, as illustrated in FIG. 16. In other words, the control unit 200 extends the sheet-to-sheet interval until speed variation of the intermediate transfer belt 24 settles down.

Thus, extending the sheet-to-sheet interval until speed variation of the intermediate transfer belt 24 settles down, and waiting for the following image formation primarily prevent the image from being affected by speed variation, enabling preventing out of color registration and image unevenness. Other structures and operations are similar to those in the first exemplary embodiment.

A fifth exemplary embodiment of the present invention will be described below with reference to FIGS. 17 to 19, referring to FIGS. 1 and 2. In the present exemplary embodiment, when the control unit 200 turns off the drive of the development sleeve 5 in sheet-to-sheet interval control described in the first exemplary embodiment, the developing bias is set to be closer to the charging potential (predetermined potential) of the photosensitive drum 10 than the developing bias at the normal image transfer time.

Specifically, in the first exemplary embodiment, the control unit 200 turns off the primary transfer bias when the drive of the development sleeve 5 is stopped, for example, for sheet-to-sheet interval adjustment, thus preventing speed variation of the photosensitive drum 10 or the intermediate transfer belt 24. However, depending on the characteristics of a high-voltage circuit board for the primary transfer bias, a certain amount of a reduction time $\tau$ arises when the control unit 200 turns on and off a high voltage. Therefore, the control unit 200 may be unable to turn on and off the high voltage before the drive of the development sleeve 5 is stopped.

Figure 17:
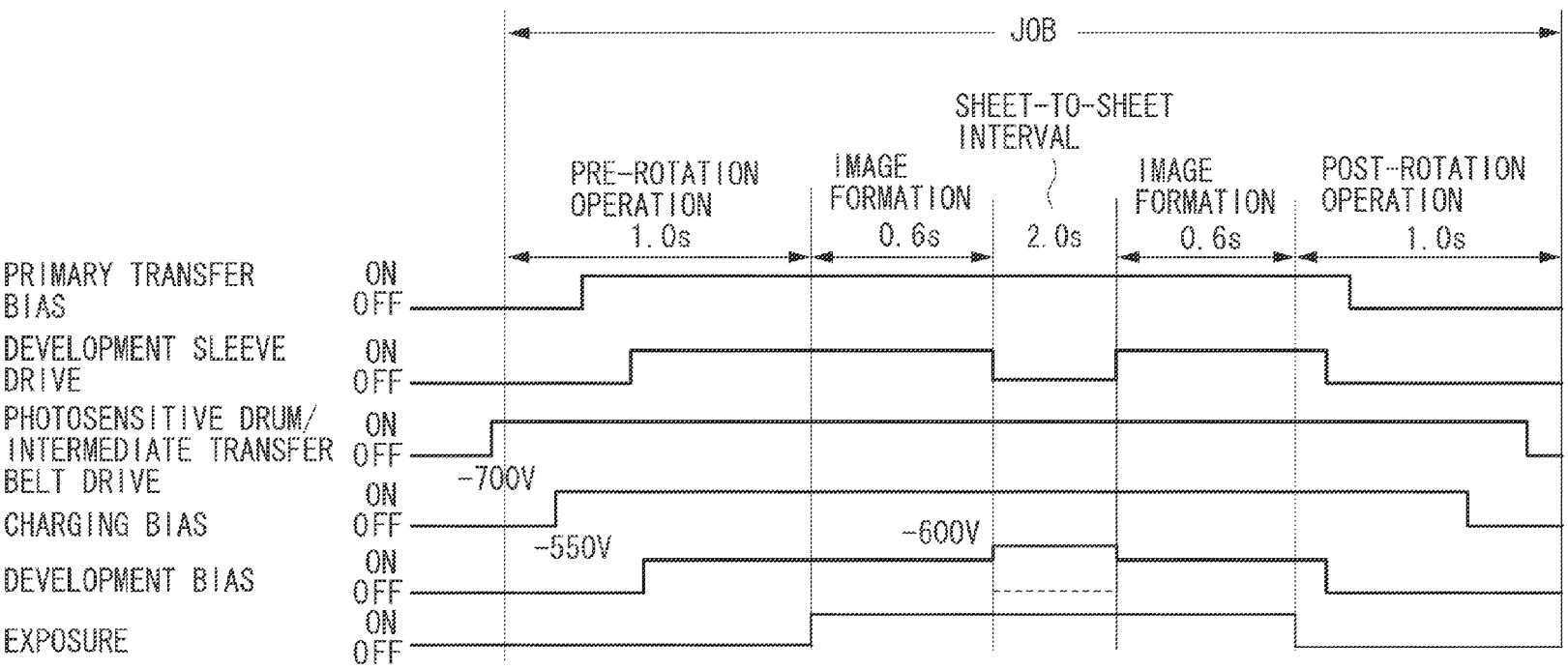
FIG. 17 is a timing chart illustrating operations of respective units of an image forming unit according to a fifth exemplary embodiment of the present invention.
Figure 18:
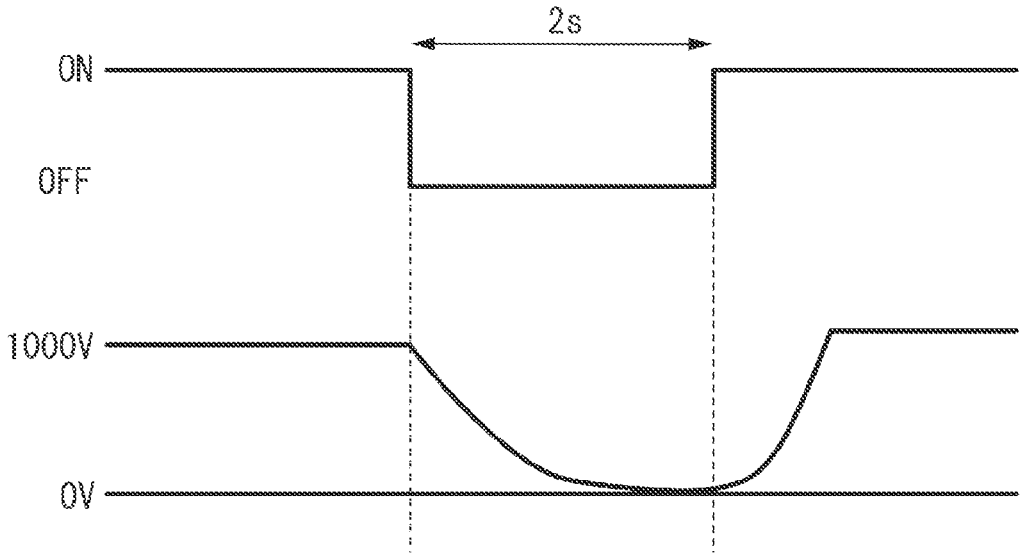
FIG. 18 illustrates a relation between ON/OFF signal of a primary transfer bias and actual potential variation according to the fifth exemplary embodiment.

For example, it may take second or longer since a primary transfer bias OFF signal is input as a control signal until the actual voltage value becomes 0V, as illustrated in FIG. 17. Further, it may take about 500 ms since the control signal is turned on until the actual voltage value becomes a desired value. This time period results from the fact that the charge and discharge take time due to the capacitance of the high-voltage substrate.

With such a high-voltage circuit board, adopting the configuration for turning off the primary transfer bias in the developer bearing member stop mode as in the first exemplary embodiment delays actual voltage value variation, and therefore sufficient effects may not be obtained. To obtain sufficient effects, the sheet-to-sheet interval needs to be extended.

Accordingly, in the present exemplary embodiment, the control unit 200 changes the developing bias without changing the primary transfer bias in the developer bearing member stop mode, supposing a case where the above-described high-voltage circuit board is used. Then, while the drive of the development sleeve 5 is stopped in the sheet-to-sheet interval, the control unit 200 reduces the difference between the charging potential Vd and the developing bias Vdc to enable supplying fogging toner on the photosensitive drum 10 even while the drive of the development sleeve 5 is stopped.

Specifically, since residual toner exists on the surface of the development sleeve 5 even after development, the control unit 200 sets the developing bias closer to the charging potential of the photosensitive drum 10 than the developing bias at the normal image transfer time, allowing residual toner to easily transfer onto the photosensitive drum 10. As a result, fogging toner can be supplied to the photosensitive drum 10 even while the drive of the development sleeve 5 is stopped.

The sequence according to the present exemplary embodiment will be described below with reference to FIG. 18. Similar to the first exemplary embodiment, when the control unit 200 determines that the sheet-to-sheet interval is prolonged because of sheet-to-sheet interval adjustment, the control unit 200 stops the drive of the development sleeve 5 . At this timing, in the present exemplary embodiment, the control unit 200 changes the developing bias from −550V at the normal image transfer time to −600V, instead of turning off the developing bias. Thus, the control unit 200 reduces a potential difference Vback between the charging potential Vd of the photosensitive drum 10 and the developing bias Vdc, allowing fogging toner to easily fly onto the photosensitive drum 10 even while the development sleeve 5 is stopped.

Thus, in the present exemplary embodiment, the control unit 200 changes the developing bias to supply fogging toner to the photosensitive drum 10 in the developer bearing member stop mode. When fogging toner is supplied to the photosensitive drum 10, fogging toner is supplied between the photosensitive drum 10 and the intermediate transfer belt 24 , reducing frictional force variation. As a result, as in the first exemplary embodiment, speed variation of the intermediate transfer belt 24 can be prevented, reducing out of color registration and image unevenness.

Figure 19:
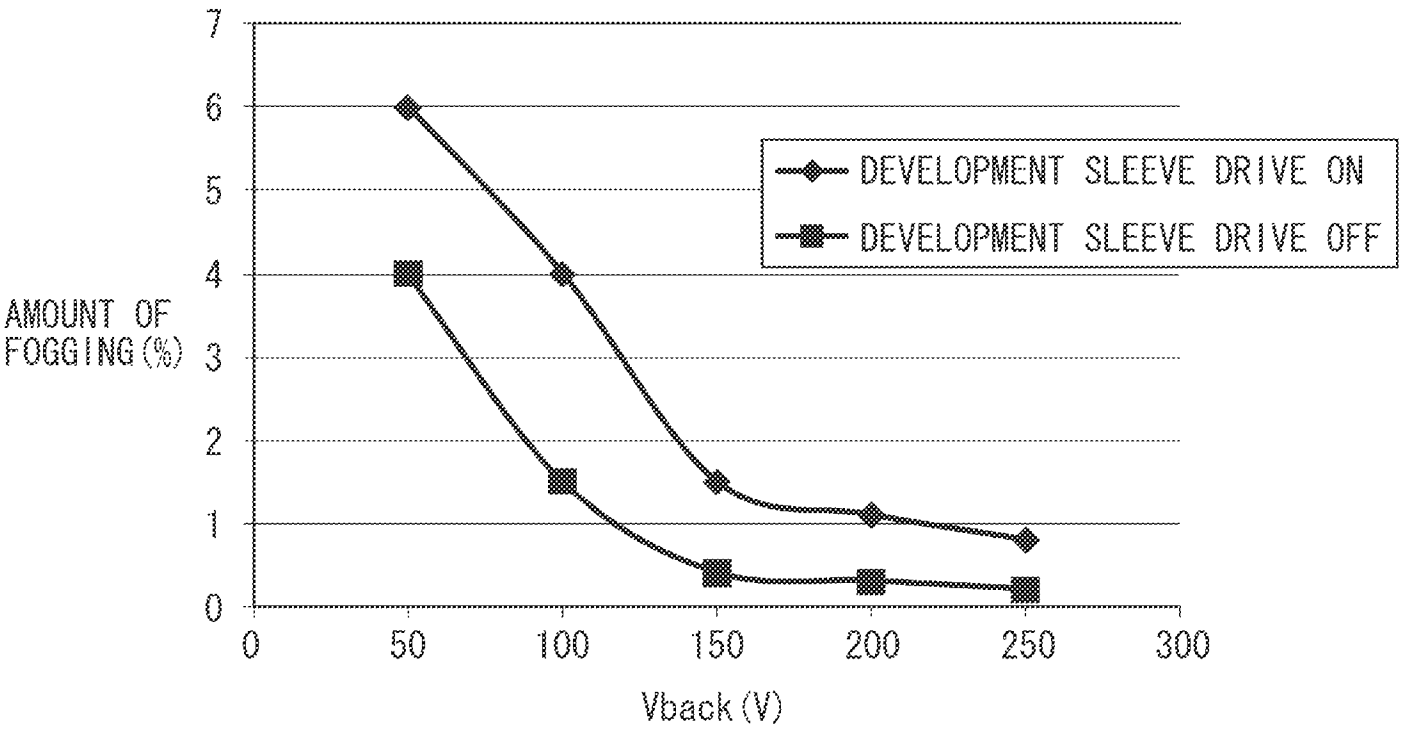
FIG. 19 illustrates a relationship between a potential difference between the charging potential and the developing bias and the amount of fogging toner in a normal state and a state where a development sleeve is stopped.

FIG. 19 illustrates a relationship between the potential difference Vback and the amount of fogging toner in cases where the drive of the development sleeve 5 is turned on and off. The amount of fogging toner was measured by using the TC-6MC-D reflection densitometer from TOKYO DENSHOKU Co., LTD. In this case, a larger numerical value indicates a greater amount of fogging toner.

FIG. 19 illustrate that the amount of fogging toner differ between a state where the drive of the development sleeve 5 is ON and a state where the drive is OFF. In the present exemplary embodiment, the potential difference Vback between the charging potential Vd of the photosensitive drum 10 and the developing bias Vdc is normally 150V (when the drive of the development sleeve 5 is ON), and the amount of fogging toner is 1.5%. However, while the drive of the development sleeve 5 is stopped and when the potential difference Vback is 150V, the amount of fogging toner decreases to as low as 0.3%, resulting in a state where fogging toner almost disappears.

In the present exemplary embodiment, the control unit 200 sets the developing bias Vdc to −600V and sets the potential difference Vback to 100V from 150V only while the drive of the development sleeve 5 is stopped. Thus, as illustrated in FIG. 19, the control unit 200 can sets the amount of fogging toner to 1. 5% which is the same value as the one when the drive of the development sleeve 5 is ON. As a result, although the drive of the development sleeve 5 is stopped, the control unit 200 can supply fogging toner between the photosensitive drum 10 and the intermediate transfer belt 24 to prevent speed variation of the intermediate transfer belt 24 , thus reducing out of color registration and image unevenness. Other structures and operations are similar to those in the first exemplary embodiment.

In addition to changing the developing bias in the developer bearing member stop mode as in the present exemplary embodiment, the control unit 200 may also lower the primary transfer bias as in the first exemplary embodiment. As in the second exemplary embodiment, in the monochrome mode, the control unit 200 may also change the developing bias for black (K). In addition to reducing or zeroing the circumferential speed difference between the photosensitive drum 10 and the intermediate transfer belt 24, the control unit 200 may also change the developing bias as in the third exemplary embodiment. In short, the present exemplary embodiment can be implemented suitably in combination with the first and second exemplary embodiments.

A sixth exemplary embodiment will be described below.

In the above-described exemplary embodiments, when the control unit 200 resumes the developer conveyance from the developer bearing member stop mode between images in continuous image formation, the control unit 200 changes the abutting state or relative speed state between the image bearing member and the image conveyance member from that state at the normal image transfer time. However, the present invention is also applicable to a case where image formation is started, as described below.

Applying the primary transfer bias when starting image formation produces an electrostatic adsorption force between the image bearing member and the primary transfer roller 23. The mutual pinching force is increased by the electrostatic adsorption force to cause load variation, generating rotation unevenness. If electrostatic latent image formation (exposure) is started while rotation unevenness is generated, an electrostatic latent image on the image bearing member is disturbed, causing image deterioration, such as out of color registration.

Possible solutions include turning on the primary transfer bias for all colors during image forming operation. In this case, if the control unit 200 starts an electrostatic latent image forming operation (exposure) after turning on the primary transfer bias, the image bearing member arranged on the most downstream side inevitably has a longer primary transfer bias application time and hence a shorter life than the image bearing member arranged on the most upstream side. Likewise, the primary transfer roller arranged on the most downstream side inevitably has a longer primary transfer bias application time and hence a shorter life than the primary transfer roller arranged on the most upstream side.

Figure 20A:
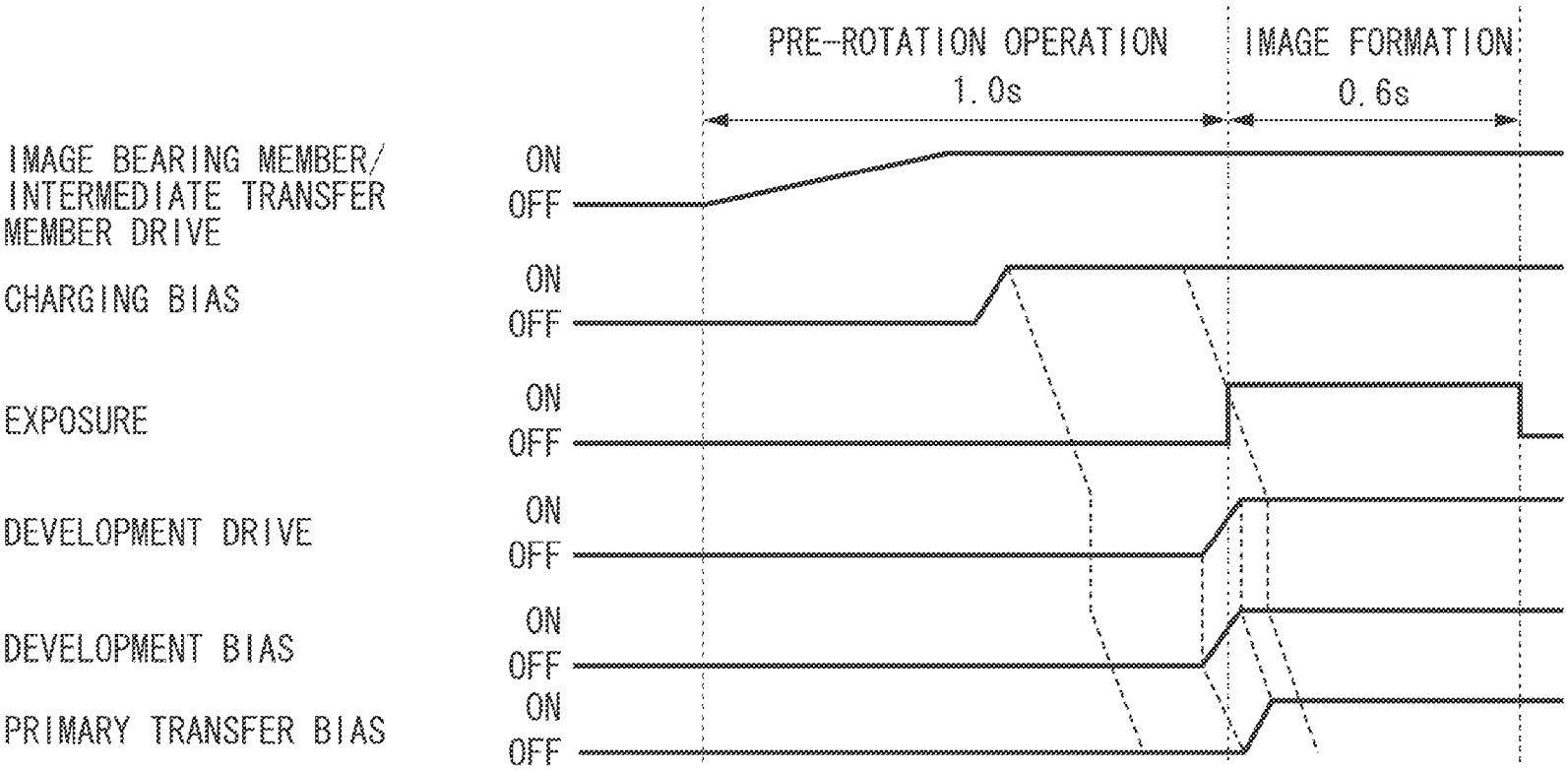
FIG. 20A is a timing chart illustrating operations of an image forming unit at the start of image formation according to a sixth exemplary embodiment of the present invention.
Figure 20B:
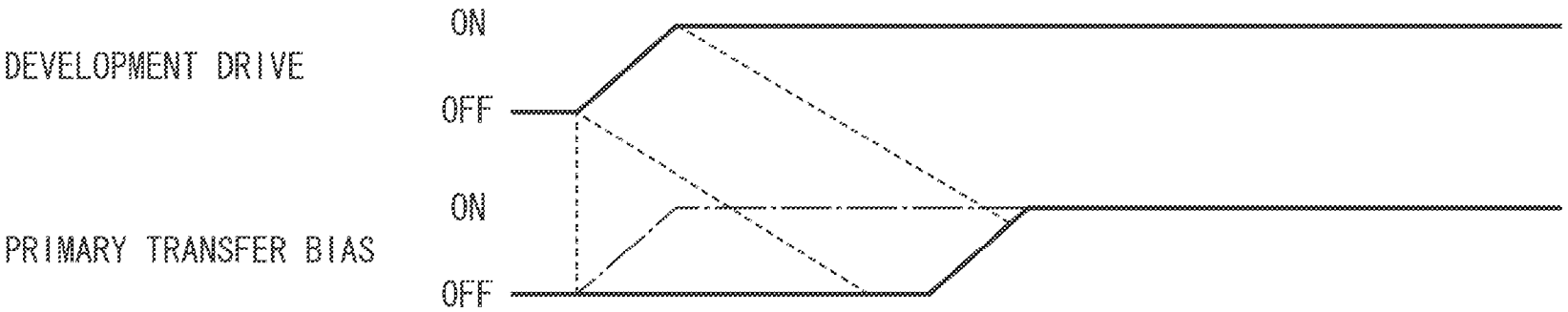
FIG. 20B is a timing chart illustrating operations of the image forming unit at the start of image formation according to the sixth exemplary embodiment of the present invention. The solid lines indicate a case where the primary transfer bias is applied at a primary transfer portion at which fogging toner of the photosensitive drum exists, and the chain line indicates a case where developing device drive and primary transfer bias application are simultaneously performed.

Therefore, in the present exemplary embodiment, the control unit 200 starts the primary transfer bias application and the developing device drive at the timings as illustrated in FIGS. 20A and 20B.

FIGS. 20A and 20B illustrate examples of the timings of primary transfer bias application and the developing device drive which are features of the present exemplary embodiment. As illustrated in FIGS. 20A and 20B, after starting the developing device drive, the control unit 200 applies the primary transfer bias at the timing when fogging toner reaches and passes through the primary transfer portion T1. Accordingly, an increasing component and a decreasing component negate each other, preventing load variation.

The above-described sequence enables starting exposure without waiting until speed variation settles down, eliminating the need of prolonging First Copy Out Time (F-COT). Likewise, the control unit 200 can start the developing device drive and the primary transfer bias application at almost the same timing as when an electrostatic latent image reaches the development position, thus preventing from being shortened the life of the photosensitive drum 10, the primary transfer roller 23, and the developer as much as possible.

Other Exemplary Embodiments

According to the above-described exemplary embodiments, the intermediate transfer belt 24 is described to rotate at lower speed than the photosensitive drum 10. Of course, the present invention is also applicable to a case where the photosensitive drum 10 rotates at lower speed than the intermediate transfer belt 24. In this case, since speed variation of the photosensitive drums 10 can be prevented, out of color registration and image unevenness can be reduced. According to the above-described exemplary embodiments, the present invention is described to be applied to an image forming apparatus employing the intermediate transfer method. However, the present invention is also applicable to an image forming apparatus employing the direct transfer method in which an image is directly transferred from the image bearing member onto a recording material. In this case, conveyance members, such as a recording material conveying belt for conveying a recording material, serve as image conveyance members. With this configuration, the normal image transfer time refers to the time when an image formed on the image bearing member is transferred onto a recording material. Even with the intermediate transfer method, the intermediate transfer member is not limited to an intermediate transfer belt, and may be an intermediate transfer drum formed in a drum shape. The present invention is also applicable to a monochromatic image forming apparatus in addition to the above-described full color image forming apparatus.

Effect of the Invention

According to the present invention, when the control unit 200 resumes the developer conveyance, the control unit 200 changes the abutting state or relative speed state between the image bearing member and the image conveyance member from that state at the normal image transfer time in the developer bearing member stop mode, so as to reduce variation in relative speed between image bearing member and the image conveyance member. Accordingly, even when the control unit 200 resumes the once stopped developer conveyance by the developer bearing member, it is possible to reduce the possibility of image unevenness and out of color registration due to speed variation of the image bearing member or the image conveyance member, whichever is rotating at lower speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-175890 filed Aug. 8, 2012 and No. 2012-196676 filed Sep. 6, 2012, which is hereby incorporated by reference herein in its entirety.

What is claimed is:

1. An image forming apparatus comprising:

an image bearing member configured to bear and convey an image;

a developing device comprising a developer bearing member configured to bear a developer and convey the developer to a developing position facing the image bearing member, and a developing bias application unit configured to apply a developing bias between the developer bearing member and the image bearing member to transfer the developer conveyed to the development position onto the image bearing member;

an image conveyance member configured to abut on the image bearing member and convey an image transferred thereon from the image bearing member or a recording material with an image transferred thereon at a speed different from the speed of the image bearing member;

a transfer portion configured to apply a transfer bias to transfer an image from the image bearing member onto the image conveyance member or a recording material;

an execution unit configured to be capable of executing a stop mode in which the developer conveyance by the developer bearing member is stopped in a period between images in continuous image formation; and a control unit configured to change a relative state in a period of the stop mode and in a period when the image is transferred, wherein an abutting state or a state of relative speed between the image bearing member and the image conveyance member is defined as the relative state.

2. The image forming apparatus according to claim 1, wherein the image conveyance member is an intermediate transfer member to which an image is transferred from the image bearing member.

3. The image forming apparatus according to claim 1, wherein, the control unit is configured to change the relative state in a period between a time when the developer conveyance by the developer bearing member is stopped, and a time when a position of the image bearing member, having faced the developer bearing member when the developer conveyance by the developer bearing member was stopped, passes through between the image bearing member and the image conveyance member.

4. The image forming apparatus according to claim 1, wherein, the control unit is configured to return the relative state in a period between a time when a position of the image bearing member, having faced the developer bearing member when the once stopped developer conveyance by the developer bearing member was resumed, reaches between the image bearing member and the image conveyance member, and a time when an image first formed on the image bearing member reaches between the image bearing member and the image conveyance member after the developer conveyance by the developer bearing member is resumed.

5. The image forming apparatus according to claim 1, further comprising:

a transfer bias application unit configured to apply the transfer bias to the transfer portion, wherein the control unit is configured to control the transfer bias application unit to lower transfer bias applied to the transfer portion in the stop mode below transfer bias in the period when the image is transferred, or not to apply transfer bias to the transfer portion in the stop mode.

6. The image forming apparatus according to claim 1, wherein the image conveyance member is formed of an endless belt, wherein the transfer portion includes a transfer member arranged to abut on and separate from the image bearing member via the belt and configured to abut on the image bearing member in the period when the image is transferred, and an abutting/separating unit configured to cause the transfer member to abut on or separate from the image bearing member via the belt, and wherein the control unit controls the abutting/separating unit to separate the transfer member from the image bearing member in the stop mode.

7. The image forming apparatus according to claim 6, further comprising:

a plurality of image forming units each comprising the image bearing member, the developing device, and the transfer portion, wherein the control unit is configured to control the abutting/separating unit to separate the transfer member of at least one image forming unit out of the plurality of image forming units in the stop mode.

8. The image forming apparatus according to claim 1, further comprising:

a first driving member configured to drive the image bearing member; and a second driving member configured to drive the image conveyance member, wherein the control unit is configured to control at least either one of the first and second driving members to lower the relative speed difference between the image bearing member and the image conveyance member in the stop mode below the relative speed difference in the period when the image is transferred.

9. The image forming apparatus according to claim 1, wherein the control unit is configured to stop the drive of the image bearing member and the image conveyance member in the stop mode.

10. The image forming apparatus according to claim 1, further comprising:

a charging device configured to charge the surface of the image bearing member to a predetermined potential, wherein the control unit is configure to control the developing bias application unit to set the developing bias applied to the developer bearing member in the stop mode closer to the predetermined potential than the developing bias in the period when the image is transferred.

11. An image forming apparatus comprising:

an image bearing member configured to bear and convey an image;

a charging device configured to charge the surface of the image bearing member to a predetermined potential;

a developing device comprising a developer bearing member configured to bear a developer and convey the developer to a developing position facing the image bearing member, and a developing bias application unit configured to apply a developing bias between the developer bearing member and the image bearing member to transfer the developer conveyed to the development position onto the image bearing member based on a potential difference from the image bearing member;

an image conveyance member configured to abut on the image bearing member and convey an image transferred thereon from the image bearing member or a recording material with an image transferred thereon at a speed different from the speed of the image bearing member;

a transfer portion configured to apply a transfer bias to transfer an image from the image bearing member onto the image conveyance member or a recording material;

an execution unit configured to be capable of executing a stop mode in which the developer conveyance by the developer bearing member is stopped between images in continuous image formation; and a control unit configured to control the developing bias application unit to set the developing bias applied to the developer bearing member in the stop mode closer to the predetermined potential than the developing bias in a period when the image is transferred.

12. An image forming apparatus comprising:

an image bearing member configured to bear and convey an image;

a developing device comprising a developer bearing member configured to bear a developer and convey the developer to a developing position facing the image bearing member, and a developing bias application unit configured to apply a developing bias between the developer bearing member and the image bearing member to transfer the developer conveyed to the development position onto the image bearing member based on a potential difference from the image bearing member;

an image conveyance member configured to abut on the image bearing member and convey an image transferred thereon from the image bearing member or a recording material with an image transferred thereon at a speed different from the speed of the image bearing member;

a transfer portion configured to apply a transfer bias to transfer an image from the image bearing member onto the image conveyance member or a recording material;

an execution unit configured to be capable of executing a stop mode in which the developer conveyance by the developer bearing member is stopped between images in continuous image formation; and a control unit configured to perform first image formation after the developer conveyance by the developer bearing member is resumed to start after the stop mode, when a predetermined time period has elapsed since a position of the image bearing member, having faced the developer bearing member, reached between the image bearing member and the image conveyance member.

13. An image forming apparatus comprising:

a movable image bearing member configured to bear a toner image;

a developing device comprising a rotatable developer bearing member, the developer bearing member bearing toner and developing the electrostatic latent image formed on the image bearing member with toner at a developing portion, the developing portion being formed at a portion between the developer bearing member and the image bearing member;

a movable intermediate transfer belt configured to abut on the image bearing member and configured to bear the toner image transferred from the image bearing member, then the toner image being transferred to a recording material;

a first driving source configured to drive the image bearing member;

a second driving source configured to drive the intermediate transfer belt, a speed of the intermediate transfer belt and the speed of the image bearing member being set by a different value;

a transfer member configured to transfer the toner image on the image bearing member onto the intermediate transfer belt at a transfer portion, the transfer portion being formed at a portion between the image bearing member and the intermediate transfer belt;

a transfer voltage source configured to apply a transfer voltage to the transfer member;

an execution unit configured to execute a stop mode, the stop mode being executed in a period between images during continuous image formation, a rotation of the developer bearing member being turned off and being in a state of rest during a period from a first timing to a second timing, the image bearing member and the intermediate transfer belt being moved at least in the stop mode; and a control unit configured to change the transfer voltage from a first voltage to a second voltage at a time between the rotation of the developer bearing member being turned off and the a first region of the image bearing member passing through the transfer portion, and configured to change the transfer voltage from the second voltage to the first voltage at a time between a second region of the image bearing member reaching the transfer portion and the most downstream position, with respect to a moving direction of the image bearing member, of the first image after the second timing reaching the transfer portion, the first region being defined as a region of the image bearing member facing the developing portion at the first timing, the second region being defined as a region of the image bearing member facing the developing portion at the second timing, the first voltage being the transfer voltage when the toner image formed on the image bearing member is transferred to the intermediate transfer belt, the second voltage being the transfer voltage having the same polarity as the first voltage and an absolute value of the second voltage being smaller than the absolute value of the first voltage, or the second voltage being zero volt.

* * * * *